US012085067B2

(12) United States Patent
Kawaguchi et al.

(10) Patent No.: US 12,085,067 B2
(45) Date of Patent: Sep. 10, 2024

(54) VALVE MODULE, FLUID CONTROL APPARATUS, AND ELECTRONIC APPARATUS

(71) Applicant: SONY GROUP CORPORATION, Tokyo (JP)

(72) Inventors: Hiroto Kawaguchi, Tokyo (JP); Hiroshi Suzuki, Tokyo (JP); Yuya Horiuchi, Tokyo (JP); Takuma Matsushita, Tokyo (JP); Daisuke Mizuta, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 0 days.

(21) Appl. No.: 17/755,546

(22) PCT Filed: Oct. 27, 2020

(86) PCT No.: PCT/JP2020/040175
§ 371 (c)(1),
(2) Date: May 2, 2022

(87) PCT Pub. No.: WO2021/090729
PCT Pub. Date: May 14, 2021

(65) Prior Publication Data

US 2022/0372965 A1 Nov. 24, 2022

(30) Foreign Application Priority Data

Nov. 8, 2019 (JP) ..... 2019-203225

(51) Int. Cl.
*F04B 43/04* (2006.01)
*F04B 49/22* (2006.01)

(52) U.S. Cl.
CPC ..... *F04B 43/04* (2013.01); *F04B 49/22* (2013.01)

(58) Field of Classification Search
CPC ..... F04B 39/1073; F04B 43/04–046; F04B 49/22; F16K 15/1402; F16K 15/16
(Continued)

(56) References Cited

U.S. PATENT DOCUMENTS 6,237,619 B1 * 5/2001 Maillefer ..... F16K 99/0001 137/859
7,044,164 B2 * 5/2006 Carlson ..... F16K 17/0453 454/162
(Continued)

FOREIGN PATENT DOCUMENTS

CN 1397734 A * 2/2003 ..... F04B 43/046
CN 107923385 A * 4/2018 ..... F04B 43/02
(Continued)

OTHER PUBLICATIONS

International Search Report and Written Opinion of PCT Application No. PCT/JP2020/040175, issued on Dec. 22, 2020, 09 pages of ISRWO.

*Primary Examiner* — Alexander B Comley
(74) *Attorney, Agent, or Firm* — CHIP LAW GROUP

(57) ABSTRACT

Provided is a valve module that includes a movable member and a support member. The movable member is constituted by a film elastically deformable by a fluid and having a first surface positioned on a side of a member having an opening through which the fluid passes and a second surface on a side opposite to the first surface. The support member has higher rigidity than rigidity of the movable member, covers a part of a region of the second surface, in which the opening is not located as viewed in a direction perpendicular to the second surface, and is fixed to the member.

19 Claims, 18 Drawing Sheets

(58) Field of Classification Search
USPC ..... 137/852, 854–855
See application file for complete search history.

(56) References Cited

U.S. PATENT DOCUMENTS

| | | | | |
|---|---|---|---|---|
| 7,291,960 | B2 * | 11/2007 | Iwashita | B41J 2/14233 310/363 |
| 7,679,262 | B2 * | 3/2010 | Meng | H02N 2/14 310/317 |
| 8,205,640 | B2 * | 6/2012 | Kawamura | F04B 53/108 137/516.25 |
| 2006/0232167 | A1 * | 10/2006 | Jordan | H10N 30/03 310/324 |
| 2007/0083677 | A1 * | 4/2007 | Cecka | A61M 15/0015 710/1 |
| 2011/0280755 | A1 * | 11/2011 | Wackerle | F04B 43/046 417/559 |
| 2014/0286795 | A1 * | 9/2014 | Kamitani | F04B 49/007 417/62 |
| 2015/0174910 | A1 * | 6/2015 | Kaneko | F04B 43/046 347/85 |
| 2020/0355278 | A1 * | 11/2020 | Kawamura | F16K 27/0236 |

FOREIGN PATENT DOCUMENTS

| | | | | |
|---|---|---|---|---|
| EP | 2096309 | A1 * | 9/2009 | F04B 39/1093 |
| JP | 2009156454 | A * | 7/2009 | |
| JP | 2011256741 | A * | 12/2011 | |
| JP | 2014095347 | A * | 5/2014 | |
| JP | 2015-117647 | A | 6/2015 | |
| WO | WO-2011040320 | A1 * | 4/2011 | F04B 43/046 |

* cited by examiner

FIG. 15A
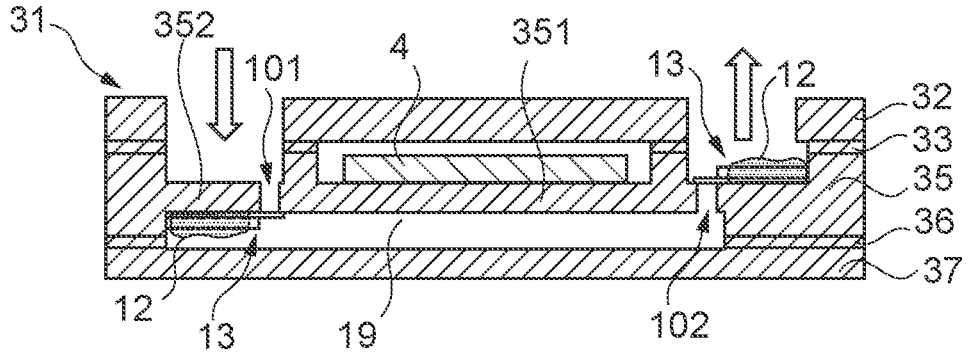
FIG. 15B
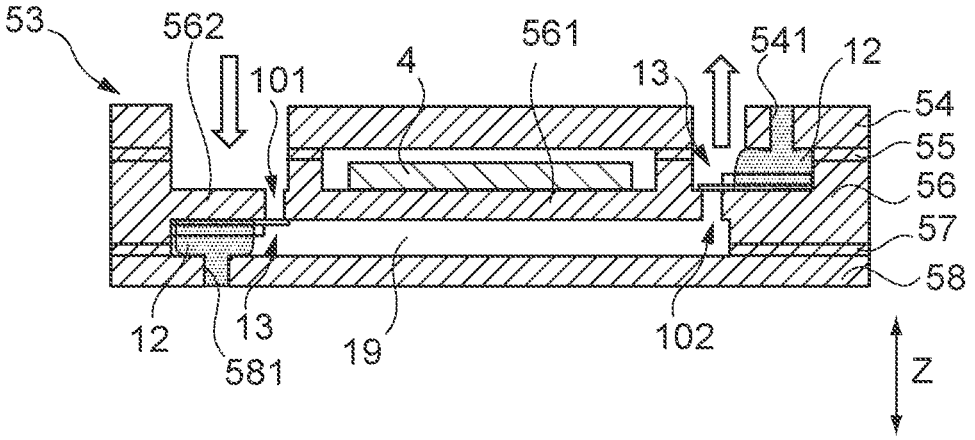
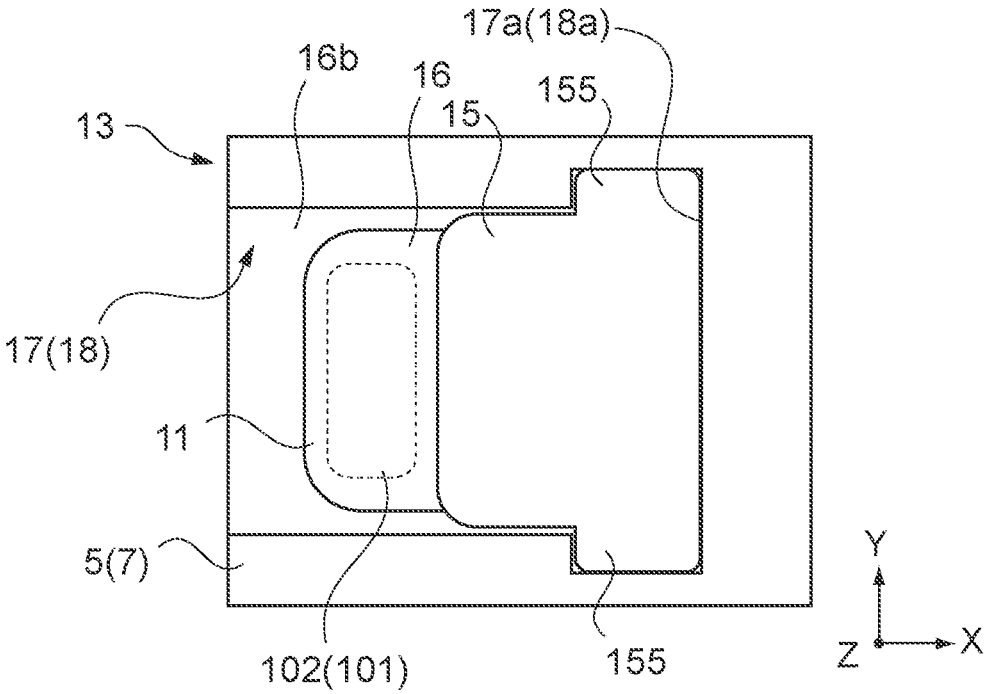
FIG.16

VALVE MODULE, FLUID CONTROL APPARATUS, AND ELECTRONIC APPARATUS

CROSS REFERENCE TO RELATED APPLICATIONS

This application is a U.S. National Phase of International Patent Application No. PCT/JP2020/040175 filed on Oct. 27, 2020, which claims priority benefit of Japanese Patent Application No. JP 2019-203225 filed in the Japan Patent Office on Nov. 8, 2019. Each of the above-referenced applications is hereby incorporated herein by reference in its entirety.

TECHNICAL FIELD

The present technology relates to a valve module used for a fluid control apparatus that transports a fluid and to a fluid control apparatus and an electronic apparatus using the same.

BACKGROUND ART

For example, diaphragm pumps using diaphragms have been in practical use as compact and thin pumps (e.g., see Patent Literature 1). A diaphragm pump has a pump chamber that varies in volume with bending deformation of the diaphragm and is capable of sucking a fluid into the pump chamber by increasing the volume and discharging a fluid from the pump chamber by reducing the volume. A suction valve and a discharge valve (valve) are provided as openings connected to the pump chamber.

CITATION LIST

Patent Literature

Patent Literature 1: Japanese Patent Application Laid-open No. 2011-256741

DISCLOSURE OF INVENTION

Technical Problem

There is a demand for downsizing a fluid control apparatus like the diaphragm pump.

Since the amount of change in volume of the pump chamber, which is caused by one vibration of the diaphragm, is small in the compact and thin diaphragm pump, it is theoretically possible to increase the flow rate per unit time by increasing the number of vibrations of the diaphragm. However, if the number of vibrations of the diaphragm is increased, there is a problem that the valve movement cannot follow pressure variations in the pump chamber and it is thus difficult to increase the flow rate.

In view of the above-mentioned circumstances, it is an objective of the present technology to provide a valve module that is suitable for a compact fluid control apparatus and a fluid control apparatus and an electronic apparatus using the same.

Solution to Problem

In order to accomplish the above-mentioned objective, a valve module according to the present technology includes a movable member and a support member.

The movable member is constituted by a film elastically deformable by a fluid and having a first surface positioned on a side of a member having an opening through which the fluid passes and a second surface on a side opposite to the first surface.

The support member has higher rigidity than rigidity of the movable member, covers a part of a region of the second surface, in which the opening is not located as viewed in a direction perpendicular to the second surface, and is fixed to the member.

In order to accomplish the above-mentioned objective, a fluid control apparatus according to the present technology includes a space, two plate-like members, a drive mechanism, an opening, and a valve module.

In the space, a fluid is capable of flowing.

The two plate-like members are opposite to each other with the space between the two plate-like members and at least one of the two plate-like members includes an elastic body having flexibility.

The drive mechanism bends the elastic body and varies volume of the space.

The fluid that flows inside and outside the space passes through the opening and the opening is provided in a member.

The valve module includes a movable member that is disposed in the opening, is constituted by a film elastically deformable by a fluid, and has a first surface positioned on a side of a member having the opening and a second surface on a side opposite to the first surface and a support member that has higher rigidity than rigidity of the movable member, covers a part of a region of the second surface, in which the opening is not located as viewed in a direction perpendicular to the second surface, and is fixed to the member.

In order to accomplish the above-mentioned objective, an electronic apparatus according to the present technology includes a fluid control apparatus.

The fluid control apparatus includes a space, two plate-like members, a drive mechanism, an opening, and a valve module.

In the space, a fluid is capable of flowing.

The two plate-like members are opposite to each other with the space between the two plate-like members and at least one of which includes an elastic body having flexibility.

The drive mechanism bends the elastic body and varies volume of the space.

The fluid that flows inside and outside the space passes through the opening and the opening is provided in a member.

The valve module includes a movable member that is disposed in the opening, is constituted by a film elastically deformable by a fluid, and has a first surface positioned on a side of a member having the opening and a second surface on a side opposite to the first surface, and a support member that has higher rigidity than rigidity of the movable member, covers a part of a region of the second surface, in which the opening is not located as viewed in a direction perpendicular to the second surface, and is fixed to the member.

BRIEF DESCRIPTION OF DRAWINGS

FIGS. 15A and 15B Schematic cross-sectional views of the fluid control apparatus for describing the arrangement example of the adhesives at the time of mounting of the valve module on the fluid control apparatus.

FIG. 16 A plan view for describing the periphery of the valve module for describing another shape of a recess portion that houses the valve module.

MODE(S) FOR CARRYING OUT THE INVENTION

A fluid control apparatus according to an embodiment of the present technology will be described.

Hereinafter, in the figure, a thickness direction of the fluid control apparatus (pump) and a valve module is defined as a Z-axis direction. Moreover, in the figure showing the periphery of the valve module, a longitudinal direction of openings (intake ports and exhaust ports) provided the fluid control apparatus, which will be described later, is defined as a Y-axis direction. The X-axis, the Y-axis, and the Z-axis are orthogonal to one another. Hereinafter, a view from the Z-axis direction will be referred to as a planar view.

[Schematic Configuration of Fluid Control Apparatus]

Figure 1:
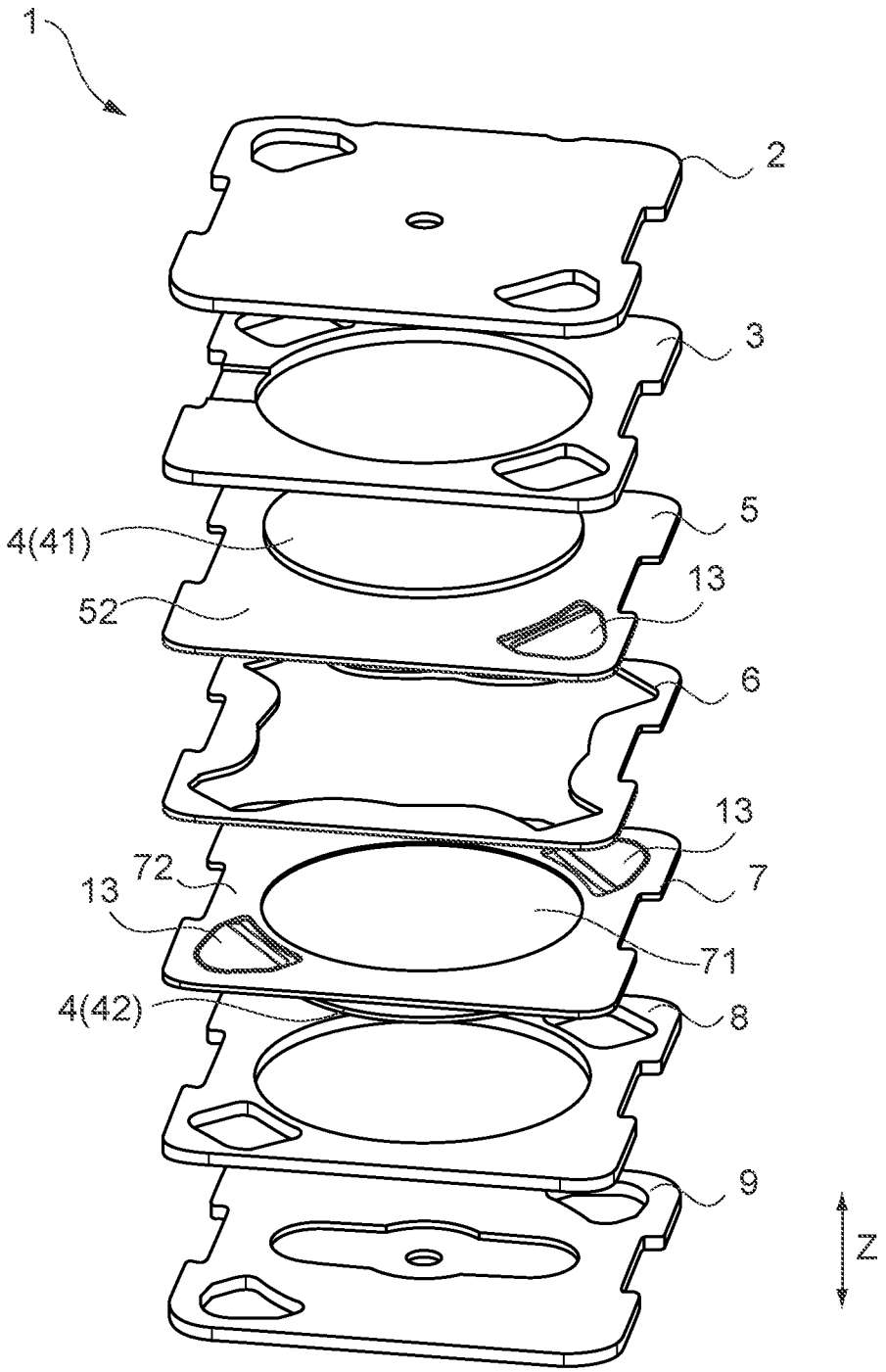
FIG. 1 An exploded perspective view of a fluid control apparatus according to an embodiment of the present technology.
Figure 2:
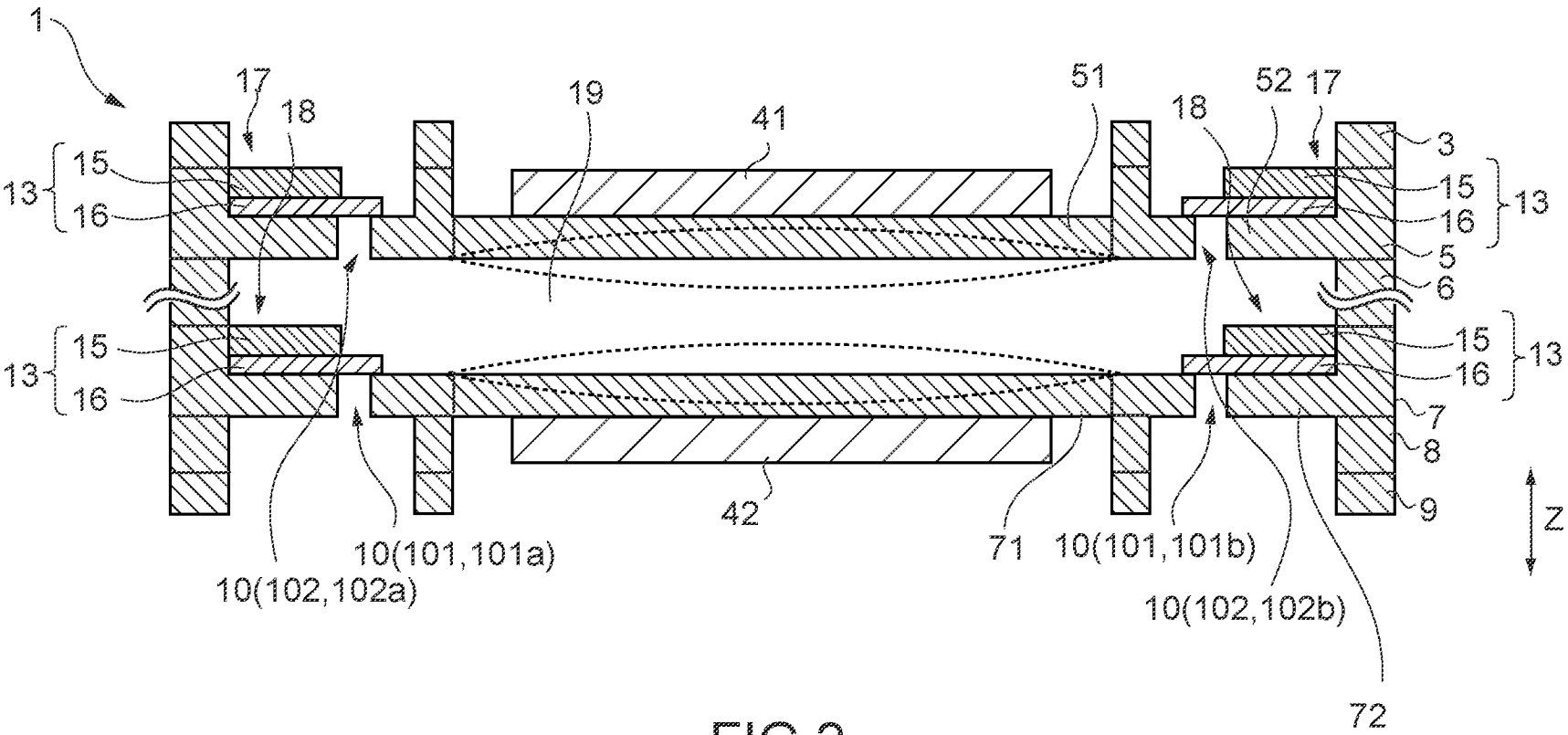
FIG. 2 A partial schematic cross-sectional view of the fluid control apparatus.

FIG. 1 is an exploded perspective view of a fluid control apparatus 1 according to this embodiment and FIG. 2 is a partial schematic cross-sectional view of the fluid control apparatus 1. The fluid control apparatus 1 is a pump capable of sucking and discharging a fluid. The fluid is a gas, a liquid, or another type of fluid, or the like, and is not particularly limited. It should be noted that in the schematic diagram of FIG. 2, the intake ports and the exhaust ports to be described later are shown to be at the same positions as the fluid control apparatus 1 is viewed in the planar view for the sake of convenience.

As shown in FIGS. 1 and 2, the fluid control apparatus 1 includes, in order from above in the figure, a first member 2, a second member 3, a first drive mechanism 41, a third member 5, a fourth member 6, a fifth member 7, a second drive mechanism 42, a sixth member 8, a seventh member 9, and four valve modules 13 and is configured by stacking them in the Z-axis direction. The first to six members are plate-like members. The fluid control apparatus 1 is configured particularly having a highly rigid metal material as its main part. Hereinafter, a portion that constitutes the fluid control apparatus 1, excluding the valve modules 13, will be referred to as a fluid control apparatus main body in some cases.

The third member 5 and the fifth member 7 are arranged in opposite to each other with a gap and a space 19 that is a pump chamber is provided between the third member 5 and the fifth member 7. The third member 5 and the fifth member 7 are bonded to the fourth member 6 and the fourth member 6 forms the space 19 together with the third member 5 and the fifth member 7. The space 19 is configured to the fluid can move there.

The third member 5 includes a vibration portion 51 and a fixed portion 52. The vibration portion 51 is a displacement vibrator that is located at the center portion of the third member 5 and constituted by an elastic body having flexibility. The shape of the vibration portion 51 is not particularly limited, and can be a circular shape in the planar view. The fixed portion 52 is disposed in the periphery of the vibration portion 51 and is constituted by a non-elastic body. The vibration portion 51 is a diaphragm and is supported by the fixed portion 52 and configured to be bent by the first drive mechanism 41.

The fifth member 7 includes a vibration portion 71 and a fixed portion 72. The vibration portion 71 is a displacement vibrator that is located at the center portion of the fifth member 7 and is constituted by an elastic body having flexibility. The shape of the vibration portion 71 is not particularly limited, and can be a circular shape in the planar view. The fixed portion 72 is disposed in the periphery of the vibration portion 71 and is constituted by a non-elastic body. The vibration portion 71 is a diaphragm and is supported by the fixed portion 72 and configured to be bent by the second drive mechanism 42.

FIG. 2 is a schematic diagram showing a bending operation of the vibration portion 51 and the vibration portion 71.

As shown in the figure, the vibration portion 51 is bent in a direction toward the fifth member 7 and a direction away from the fifth member 7. A spring portion that promotes bending of the vibration portion 51 may be provided between the vibration portion 51 and the fixed portion 52.

The vibration portion 71 is bent in a direction toward the third member 5 and a direction away from the third member 5. A spring portion that promotes bending of the vibration portion 71 may be provided between the vibration portion 71 and the fixed portion 72.

The third member 5 and the fifth member 7 are arranged so that the vibration portion 51 and the vibration portion 71 are opposite to each other with the space 19 between the vibration portion 51 and the vibration portion 71 as shown in FIG. 1. As shown in FIG. 2, the space 19 is a space that varies in volume by bending the vibration portion 51 and the vibration portion 71, and includes intake ports 101*a* and 101*b* and exhaust ports 102*a* and 102*b* as openings. In this embodiment, the example in which two intake ports and two exhaust ports are provided is shown, though the number of intake ports and the number of exhaust ports are not limited thereto. Hereinafter, unless it is particularly necessary to distinguish the intake ports 101*a* and 101*b*, the intake ports 101*a* and 101*b* will be referred to as the intake ports 101 and, unless it is particularly necessary to distinguish the exhaust ports 102*a* and 102*b*, the exhaust ports 102*a* and 102*b* will be referred to as the exhaust ports 102. Moreover, the exhaust ports 102 and the intake ports 101 will not be distinguished and will be referred to as openings 10 in some cases in the following description.

Figure 3A:
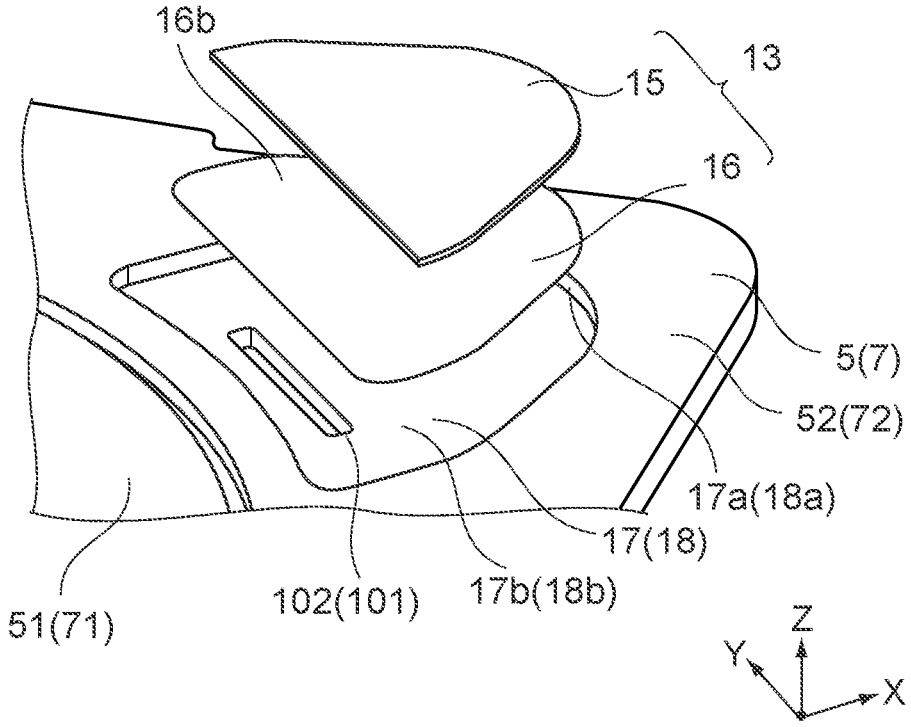
FIGS. 3A and 3B An exploded perspective views of the periphery of a valve module provided in the fluid control apparatus and a plan view of the valve module.

As shown in FIG. 3A, the intake ports 101 and the exhaust ports 102 are substantially rectangular openings having the longitudinal direction (referred to as Y-axis direction) in the planar view.

The space 19 is in communication with the external space of the fluid control apparatus 1 via the intake ports 101 and the exhaust ports 102. The intake ports 101 and the exhaust ports 102 are openings through which the fluid passes.

The first drive mechanism 41 bends the vibration portion 51. The first drive mechanism 41 can be a piezoelectric element that is stacked on the vibration portion 51 as shown in FIG. 1. Moreover, the first drive mechanism 41 does not need to be the piezoelectric element and it is sufficient that the first drive mechanism 41 is capable of bending the vibration portion 51.

The second drive mechanism 42 bends the vibration portion 71. The second drive mechanism 42 can be a piezoelectric element stacked on the vibration portion 71 as shown in FIG. 1. Moreover, the second drive mechanism 42 does not need to be the piezoelectric element and it is sufficient that the second drive mechanism 42 is capable of bending the vibration portion 71.

The valve modules 13 are provided in the intake ports 101*a* and 101*b*, respectively.

The valve modules 13 provided in the intake ports 101 suck the fluid into the space 19 via the intake ports 101. The valve modules 13 provided in the intake ports 101 allow the fluid that flows toward the space 19 from the external space to pass therethrough and do not allow the fluid that flows toward the external space from the space 19 to pass therethrough.

Also, the valve modules 13 are provided in the exhaust ports 102*a* and 102*b*, respectively.

The valve modules 13 provided in the exhaust ports 102 discharge the fluid in the space 19 to the external space via the exhaust ports 102. The valve modules 13 provided in the exhaust ports 102 allow the fluid that flows toward the external space from the space 19 to pass therethrough and do not allow the fluid that flows toward the space 19 from the external space to pass therethrough.

The fluid control apparatus 1 has a schematic configuration as described above. The thickness of the fluid control apparatus 1 is reduced due to the structure of the fluid control apparatus 1 in which the plate-like members (first member 2, second member 3, third member 5, fourth member 6, fifth member 7, sixth member 8, and seventh member 9) are stacked. The respective plate-like members can be bonded by adhesion, fastening, or another bonding method.

Although the shape of the fluid control apparatus 1 is not particularly limited, the shape of the fluid control apparatus 1 can be a substantially rectangular shape in the planar view as shown in FIG. 1. Moreover, the shape of the fluid control apparatus 1 is not limited to the rectangular shape, and may be a polygonal shape such as a hexagonal shape and an octagonal shape in the planar view.

[Operation of Fluid Control Apparatus]

An operation of the fluid control apparatus 1 will be described.

As shown in FIG. 2, when the vibration portion 51 is bent in the direction away from the fifth member 7 and the vibration portion 71 is bent in the direction away from the third member 5, the volume of the space 19 increases. Accordingly, the fluid is sucked in the space 19 via the intake ports 101. At this time, the exhaust ports 102 are closed by the valve modules 13 provided in the exhaust ports 102 and the fluid is prevented from being sucked through the exhaust ports 102.

As shown in FIG. 2, the vibration portion 51 is bent in the direction toward the fifth member 7 and the vibration portion 71 is bent in the direction toward the third member 5, the volume of the space 19 decreases. Accordingly, the fluid is discharged into the external space from the space 19 via the exhaust ports 102. At this time, the intake ports 101 are closed by the valve modules 13 provided in the intake ports 101 and the fluid is prevented from being discharged from the intake ports 101.

By repeatedly bending the vibration portions 51 and 71 in this manner, the fluid is sucked from the intake ports 101 and discharged from the exhaust ports 102 continuously. Due to the action, the fluid is transported.

[Structure of Valve Module]

As shown in FIGS. 1 and 2, the valve modules 13 are provided, fixed to the fixed portion 52 of the third member 5 and the fixed portion 72 of the fifth member 7, respectively.

The valve modules 13 exert check valve functions due to pressure variations and airflows in the space 19, which are caused by the vibration of the vibration portions 51 and 71.

The valve modules 13 are configured separately from the respective plate-like members in the fluid control apparatus 1. The fluid control apparatus 1 can be configured by mounting the valve modules 13 on the fluid control apparatus main body.

Figure 3B:
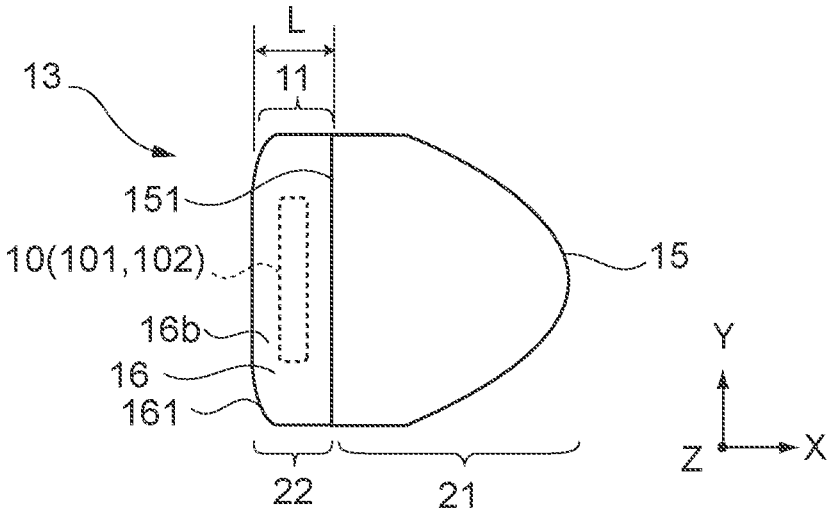

FIG. 3A is a partially exploded perspective view in the periphery of the valve modules 13 of the fluid control apparatus 1. FIG. 3B is a plan view as the single valve module 13 is viewed from above in the Z-axis direction.

Figure 4A:
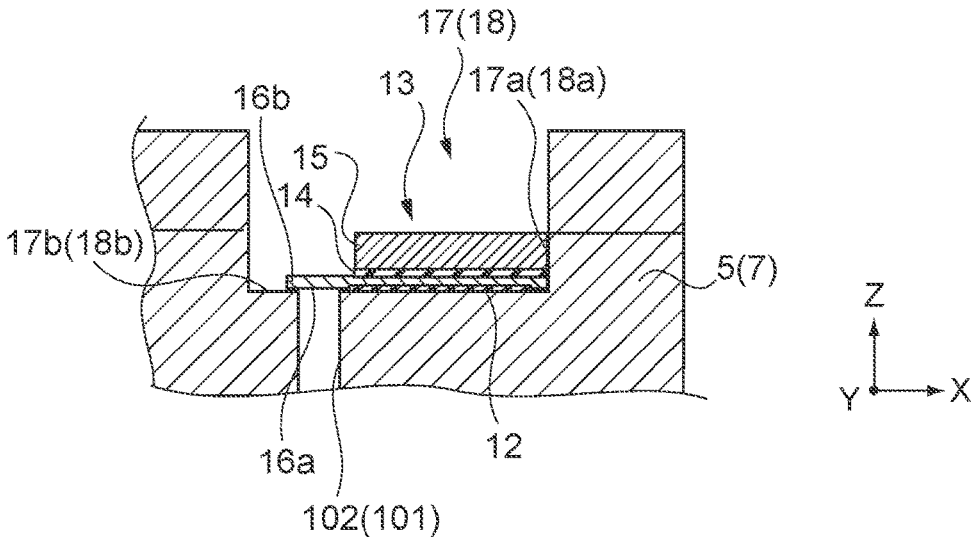
FIGS. 4A and 4B A partial schematic cross-sectional views of the periphery of the valve module provided in the fluid control apparatus and a partial schematic cross-sectional view showing a movement of a vibration portion of the valve module.
Figure 4B:
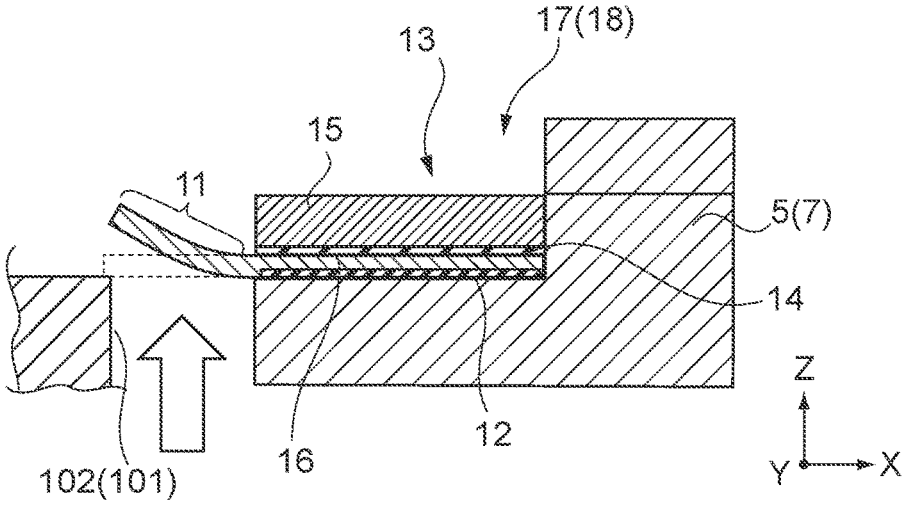

FIG. 4A is a partial schematic cross-sectional view in the periphery of the valve module 13 of the fluid control apparatus 1. FIG. 4B is a partial schematic cross-sectional view for describing a movement of the valve module 13 during the operation of the fluid control apparatus 1.

One having a similar structure can be used as the valve module 13 provided in each of the intake ports 101 and the exhaust ports 102.

As shown in FIGS. 3A and 4A, the valve module 13 is installed in the fixed portion 52 (72) of the third member 5 (fifth member 7) and fixed to the fixed portion 52 (72) through a fixation means such as adhesives 12 to be described later.

As shown in FIG. 3(A) and FIG. 4(A), the valve module 13 is installed in the fixed portion 52 (72) of the third member 5 (fifth member 7) and fixed to the fixed portion 52 (72) through a fixation means such as adhesives 12 to be described later.

The fixed portion 52 (72) is provided with a recess portion 17 (18) recessed in the Z-axis direction. In the planar view, a part of the outer shape of the recess portion 17 (18) has substantially the same shape as a part of the outer shape of the valve module 13. The recess portion 17 (18) is a mounting portion on which the valve module 13 is mounted.

The recess portion 17 (18) has an inside surface 17*a* (18*a*) and a bottom surface 17*b* (18*b*).

The inner surface 17*a* (18*a*) of the recess portion 17 (18) functions as a positioning surface that performs positioning to the fluid control apparatus main body of the valve module 13. The recess portion 17 (18) is provided with the exhaust port 102 (intake port 101) that penetrates in the Z-axis direction.

As shown in FIG. 4A, the valve module 13 includes a movable member 16, a support member 15, and an adhesive layer 14 serving as a fixation means.

The valve module 13 is a check valve utilizing elastic spring restoring force of the movable member 16, a movable valve 11 to be described later, which is a part of the movable member 16, includes a spring mechanism, and opening/closing of the opening 10 is performed utilizing this.

The movable member 16 is configured from a film elastically deformable by the fluid. The movable member 16 has a first surface 16*a* positioned on a side of the member (in this embodiment, the third member 5 or the fifth member 7) having the opening 10 through which the fluid passes and a second surface 16*b* on a side opposite to the first surface 16*a*.

The support member 15 covers a part of a region of the second surface 16*b* of the movable member 16, in which the opening 10 is not located as viewed in the direction perpendicular to the second surface 16*b*, i.e., in the planar view. The support member 15 is constituted by a material having higher rigidity than rigidity of the movable member 16. The support member 15 controls a range in which the movable member 16 is elastically deformable. Moreover, the support member 15 functions as a coupling member when the valve module is mounted on the fluid control apparatus main body and the support member 15 is fixed to each of the third member 15 and the fifth member 7 through the adhesives 12 to be described later.

The adhesive layer 14 is a fixation means that fixes the movable member 16 to the support member 15. The movable member 16 and the support member 15 are bonded to each other through the adhesive layer 14 on their opposite surfaces.

The movement of the movable member 16 is suppressed by the support member 15 in a region overlapping the support member 15 in the Z-axis direction. This overlapping region corresponds to an overlapping region 21 to be described later. The support member 15 presses a part of the movable member 16 and suppresses the movement of the overlapping region 21 when the valve module 13 is mounted on the fluid control apparatus main body and the fluid control apparatus 1 is configured.

On the other hand, the movable member 16 is elastically deformable in a region not overlapping the support member 15 in the Z-axis direction. This non-overlapping region corresponds to a non-overlapping region 22 to be described later. The non-overlapping region 22 constitutes the movable valve 11 that contributes to opening/closing of the valve module 13.

In the fluid control apparatus 1 in which the valve module 13 is installed on the fluid control apparatus main body, the movable valve 11 is deformable by the pressure or airflow from the space 19 and is in a shape having response characteristics that can follow pressure variations.

As shown in FIG. 3B, the valve module 13 has the overlapping region 21 in which the movable member 16 and the support member 15 overlap each other in the planar view and the non-overlapping region 22 in which the support member 15 is not positioned and only the movable member 16 is positioned.

The overlapping region 21 is a region in which the support member 15 is stacked and which thus has higher rigidity and less deformable than the non-overlapping region 22 in which the support member 15 is located. In this manner, the valve module 13 has the regions different in rigidity as the overlapping region 21 and the non-overlapping region 22.

The valve module 13 is installed in the recess portion (18) of the third member 5 (fifth member 7) so that the non-overlapping region 22 that constitutes the movable valve 11 covers the opening 10 and overlaps the exhaust port 102 (intake port 101) in the planar view. The boundary portion between the overlapping region 21 and the non-overlapping region 22 can be a valve-opening start point of the movable valve 11.

As shown in FIG. 4B, when the fluid is discharged (sucked) from the space 19 (external space) into the external space (space 19), the movable valve 11 of the valve module 13 provided in the exhaust port 102 (intake port 101) moves away from the fifth member 7 (third member 5) and is open.

On the other hand, when the fluid is discharged (sucked) from the external space (space 19) into the space 19 (external space), the movable valve 11 of the valve module 13 provided in the exhaust port 102 (intake port 101) moves to come into contact with the bottom surface 18*b* (17*b*) of the recess portion 18 (17) of the fifth member 7 (third member 5) and is closed. Accordingly, the fluid is prevented from being sucked (discharged) through the exhaust port 102 (intake port 101).

For the movable member 16, a material that is thin and soft and enables the movable valve 11 to vibrate largely when the valve module 13 is configured is used. For the movable member 16, it is favorable to use a material that has a desired Young's modulus and also has the smallest specific gravity in view of the response characteristics of the movable valve 11.

More specifically, a material used for the movable member 16 favorably has a Young's modulus in an appropriate range with respect to force required for opening/closing the movable valve 11. The Young's modulus of the material used for the movable member 16 is 10 GPa or less, more favorably 6 GPa or less and 2 GPa or more, more favorably 3 GPa or more.

As the material used for the movable member 16, a material having small specific gravity is favorable in view of the response characteristics of the movable valve 11 and the specific gravity is 2.3 or less, more favorably 2 or less and 0.7 or more, more favorably 0.9 or less. Reducing the specific gravity can realize a high-speed response of the movable valve 11. Accordingly, ON/OFF of the fluid control apparatus can be quickly switched. Moreover, as the specific gravity becomes smaller, the response characteristics are less deteriorated even if the L-length is increased.

Moreover, as the material used for the movable member 16, a thin material is more favorable in view of force required for opening/closing the valve, and the thickness is 20 μm or less, more favorably 15 μm or less and 2 μm or more, more favorably 5 μm or more.

Moreover, it is more favorable that the surface of the movable member 16 has less irregularities in order to suppress leakage of the fluid when the movable valve 11 is disposed in the closed state.

Moreover, it is favorable to use, as the material of the movable member 16, a material which makes physical characteristic changes of the movable valve 11, such as thermal deformation, softening, and hardening, small within an operation temperature condition range of the fluid control apparatus on which the movable member 16 is to be mounted.

Moreover, the maximum stretching rate of the material used for the movable member 16 is favorably 1% or more in view of the durability and the response characteristics.

A plastic material having small specific gravity can be used for the movable member 16.

An organic film made from polyimide, polyethylene terephthalate, polyamide, aromatic polyamide (aramid), polypropylene, polycarbonate, polybutylene terephthalate, fluorocarbon polymers, or the like can be favorably used for the movable member 16.

In order to resist the high-temperature circumstance during the manufacturing process and meet the reliability standard when it is used as a product, a material having high heat resistance is more favorable for the movable member 16. For example, a polyimide film, polyethylene terephthalate, or the like has high heat resistance, so they are favorable.

It should be noted that a metal film may be used as the movable member 16 and a metal film including an alloy of iron, such as 42-alloy, and nickel, stainless steel, and the like having a thickness of 10 μm or less can be used. The 42-alloy is an alloy of 42 mass % of nickel mixed in iron.

As a shape forming method for the movable member 16, a known method such as laser machining, etching machining, cutting, and punching, can be used, and it is selected as appropriate in accordance with the quality, thickness, machining shape, and the like of the material.

It is favorable that the material used for the support member 15 is highly rigid in order to cover the part of the movable member 16 to suppress the movement of the movable member 16 in the overlapping region 21 and prevent the entire valve module 13 from being vibrated and displaced. A material having higher rigidity than the rigidity of the movable member 16 can be used for the support member 15.

Since the support member 15 covers the part of the movable member 16, the support member 15 functions as a reinforcing material, the rigidity of the overlapping region 21 of the valve module 13 is increased, and a range of the movable valve 11, which is the movable range of the movable member 16, is determined.

Moreover, since the displacement characteristic of the movable valve 11 changes depending on the rigidity of the support member 15 to be stacked as well as the material characteristics of the movable member 16, the thickness and quality of the support member can be determined as appropriate so that the movable valve 11 can have a desired displacement characteristic.

It is favorable that the Young's modulus of the material used for the support member 15 is 6 GPa or more, more favorably 10 GPa or more in view of the rigidity required for limiting the movable range of the movable member 16.

It is sufficient that the thickness of the support member 15 is a thickness capable of limiting the movable range of the movable member 16.

A metal material capable of being subjected to shape-forming machining such as etching and press machining can be used as the support member 15, and a material including an alloy of iron, such as 42-alloy, and nickel, stainless steel, and the like, for example, can be used. Otherwise, a plastic material, an acrylonitrile-butadiene-styrene resin (ABS resin), a polycarbonate resin, a methacrylic resin, liquid crystal polymer, or the like capable of being subjected to injection molding may be used as the material of the support member 15.

In this embodiment, the fluid control apparatus 1 is provided with the recess portion 17 (18) on which the valve module 13 is mounted, and an end portion of the valve module 13, more particularly, an end portion of the support member 15 is brought into contact with the inner surface 17*a* (18*a*) of the recess portion 17 (18), such that the valve module 13 is positioned with respect to the fluid control apparatus main body.

Therefore, it is favorable to use a material that hardly deforms and has large thickness and Young's modulus for the support member 15. That is, by using the support member 15 having high rigidity, deformation of the support member 15 is suppressed when bringing the support member 15 into contact with the inner surface 17*a* (18*a*) for positioning, and highly precise positioning can be performed.

An epoxy-adhesive, a cyanoacrylate adhesive, an anaerobic curing or heat curing and ultraviolet curing adhesive, or the like can be used for the adhesive layer 14. It should be noted that the fixation means for the support member 15 and the movable member 16 is not limited to the adhesives. For example, ultrasonic bonding or thermal bonding with a thermoplastic resin may be used.

In the example of the valve module 13 shown in FIG. 3B, the non-overlapping region 22 is in a shape projecting from the overlapping region 21 in the X-axis direction. The end portion of the support member 15 in the overlapping region 21, which defines the boundary between the non-overlapping region 22 and the overlapping region 21, is denoted by the reference sign 151. Moreover, an end portion of the movable member 16 in the extending direction of the non-overlapping region 22 as viewed from the overlapping region 21 is denoted by the reference sign 161. In the figure, the end portions 151 and 161 extend in the Y-axis direction. A length when the length between the end portion 151 and the end portion 161, i.e., the length of the movable valve 11 in the X-axis direction is the maximum is denoted by L. Hereinafter, the length L will be referred to as an "L-length" in some cases.

[Actions and Effects]

In this embodiment, by using a soft material having small specific gravity and Young's modulus for the movable member 16 of the valve module 13, the movable valve 11 capable of following high-frequency vibration of the vibration portions 51 and 71 can be obtained. Accordingly, the flow rate per unit time can be increased, and a fluid control apparatus capable of increasing the flow rate per unit time even with a compact size and a small thickness can be obtained.

Moreover, in this embodiment, since the size and thickness of the fluid control apparatus can be reduced, the limitation on the installation position when installing the fluid control apparatus on the electronic apparatus is relaxed, and the design range of the electronic apparatus can be widened. In addition, the electronic apparatus can be downsized by using the fluid control apparatus according to the present technology as an electronic apparatus using a fluid control apparatus.

The valve module 13 is configured separately from the members that constitute the fluid control apparatus main body.

Accordingly, the valve module 13 can be mounted at a desired position of the fluid control apparatus 1, the number and positions of the intake ports 101 and the exhaust ports 102 can be freely designed, and the design range of the fluid control apparatus can be widened.

Regarding a manufacturing method for the valve module 13, as will be described later, the valve module 13 is fabricated by fixing the movable member 16 and the support member 15 via the adhesive layer 14. By adjusting the range of the overlapping region 21 between the movable member 16 and the support member 15 at the time of fixation of the movable member 16 and the support member 15, the L-length of the movable valve 11 can be adjusted without changing the outer shape dimensions and shapes of the movable member 16 and the support member 15. By changing the L-length, the flow rate of the fluid and the response characteristics of the movable valve 11 can be controlled for each valve module 13.

Therefore, since the fluid control apparatus main body and the valve module are separate from each other, the valve module suitable for each of different fluid control apparatus main bodies can be individually easily fabricated.

Moreover, since a suitable valve module in each of the intake ports 101 and the exhaust ports 102 can be easily fabricated, for example, a plurality of valve modules having different L-lengths can be provided in each of the intake ports 101 and the exhaust ports 102 provided in the same fluid control apparatus.

Since the valve module 13 is separate from the fluid control apparatus main body and also the flow rate and the response characteristics can be controlled by adjusting the L-length as described above, a highly versatile component is obtained.

It should be noted that although controlling the characteristics of the valve module 13 by changing the L-length has been described herein, the characteristics of the valve module can be controlled by changing the kind and thickness of the material of the movable member 16, the shapes of the movable member 16 and the support member 15, and the like other than the L-length as will be described later. A design change of tuning and the like of the pump characteristics of the fluid control apparatus using this valve module can be easily performed by changing the material of the movable member 16, for example.

Moreover, the third member 5 and the fifth member 7 on which the valve modules 13 are mounted are respectively provided with the recess portions 17 and 18 in which the valve modules 13 can be positioned and disposed. Accordingly, the valve module 13 can be accurately and easily disposed in the third member 5 (fifth member 7), and the machining efficiency at the time of mounting can be improved.

[Other Shape Examples of Valve Module]

The planar shapes of the support member 15 and the movable member 16 that constitute the valve module 13 are not limited to the shapes shown in FIGS. 3A and 3B, and can be various shapes. Hereinafter, other shape examples of the valve module will be described using FIGS. 5A, 5B, 5C, 6A, 6B, 60, 6D, 7A, 7B, 7C, 8A, 8B, 9A, 9B, and 9C, though not limited to those shapes.

Hereinafter, an example in which the shape of at least one of the support member or the movable member will be different from that of the valve module shown in FIGS. 3A and 3B will be described, and the description will be given denoting, in a manner similar to that described above, the valve module by the reference sign 13, the support member by the reference sign 15, the movable member by the reference sign 16, the adhesive layer by the reference sign 14, a movable valve by the reference sign 11, the second surface that is a surface on the side of the movable member 16, which is brought into contact with the support member 15, by the reference sign 16*b*, the overlapping region by the reference sign 21, and the non-overlapping region by the reference sign 22. Moreover, the opening (intake port or exhaust port) positioned overlapping the movable valve 11 when the valve modules 13 are installed on the fluid control apparatus main body as the fluid control apparatus 1 is denoted by the reference sign 10.

The outer shapes of the movable member 16 and the support member 15 can be set as appropriate in accordance with the mounting position and the positioning method when they are mounted on the fluid control apparatus 1.

Figure 5A:
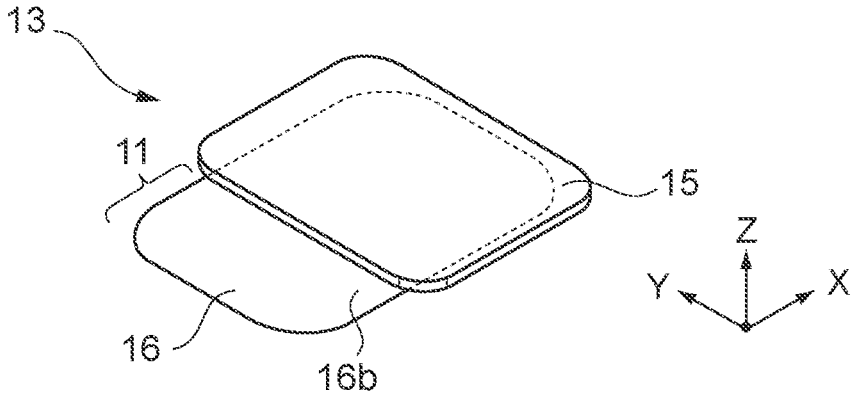
FIGS. 5A, 5B, and 5C A perspective views, a plan view, and a schematic cross-sectional view of a valve module in another shape example.
Figure 5B:
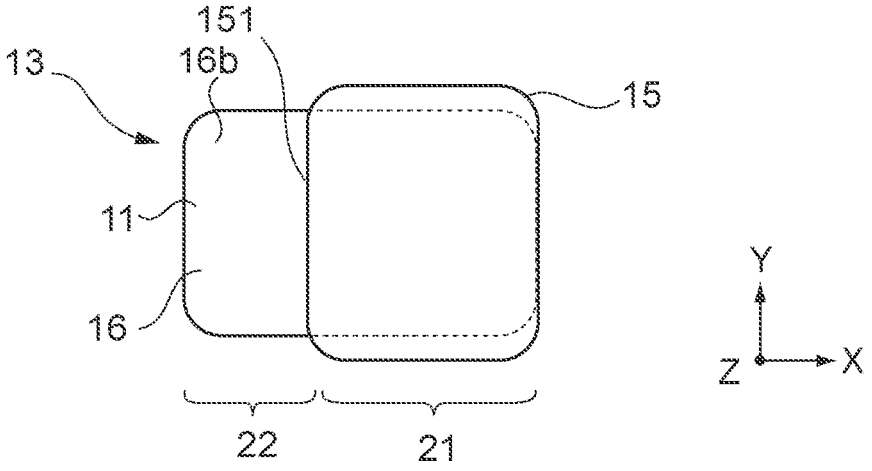
Figure 5C:
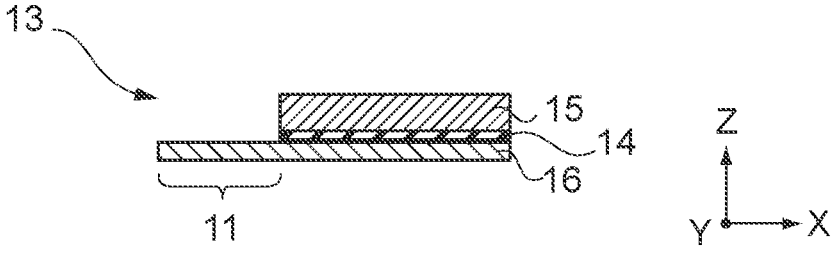

FIGS. 5A, 5B, and 5C show examples in which the shapes of the support member 15 and the movable member 16 are different from those of the valve module shown in FIGS. 3A and 3B, and are a perspective view, a plan view, and a schematic cross-sectional view of the valve module.

As in the valve module 13 shown in FIGS. 5A, 5B, and 5C, the support member 15 and the movable member 16 may have a rectangular shape with round corners. Moreover, as in the valve module 13 shown in FIGS. 5A, 5B, and 5C, the dimension of the support member 15 in the Y-axis direction may be larger than the dimension of the movable member 16 in the Y-axis direction, and the support member 15 may protrude from the movable member 16 in the Y-axis direction.

FIGS. 6A, 6B, 6C, and 6D are plan views of examples in which the shapes of the support member 15 and the movable member 16 are different from those of the valve module shown in FIGS. 3A and 3B. With all the valve modules 13, the support member 15 covers a part of a region of the second surface 16*b* of the movable member 16, in which the opening 10 is not located in the planar view.

The support member 15 and the movable member 16 of the valve module 13 shown in FIGS. 3A and 3B have a substantially semi-elliptical shape in the planar view.

In contrast, the movable members 16 of the valve modules 13 shown in FIGS. 6A, 6B, 6C, and 6D all have a rectangular shape with round corners.

Figure 6A:
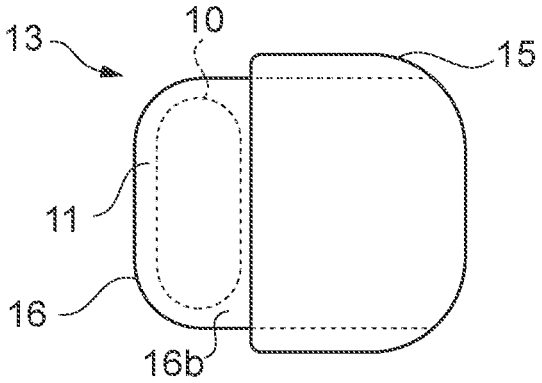
FIGS. 6A, 6B, 6C, and 6D Plan views of valve modules in still other shape examples.

The support member 15 of the valve module 13 shown in FIG. 6A has a substantially rectangular shape and two corners are curve line portions having different curvature from that of the other two corners. In addition, the support member 15 has a shape including a portion projecting from the movable member 16 in the Y-axis direction.

Figure 6B:
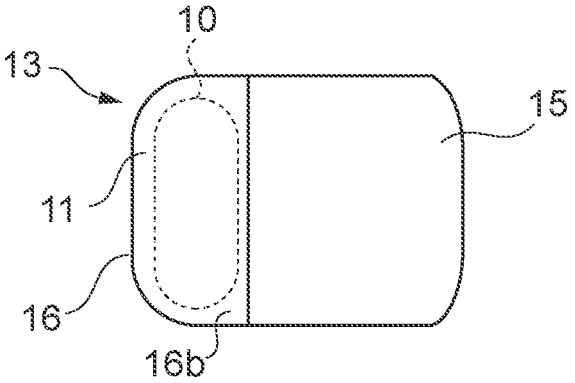

The support member 15 of the valve module 13 shown in FIG. 6B has a rectangular shape with round corners and also has a shape identical to the outer shape of the movable member 16 in the overlapping region 21.

Figure 6C:
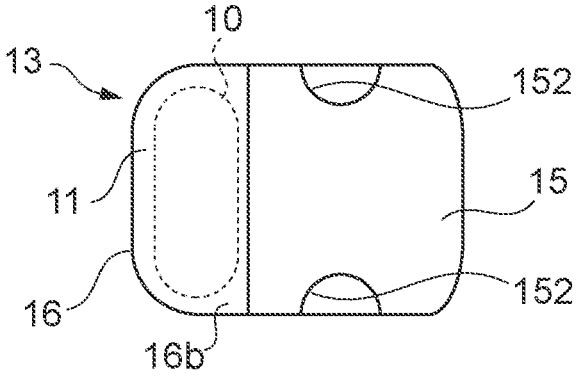

The support member 15 of the valve module 13 shown in FIG. 6C has a shape in which cutouts 152 are provided at a pair of opposite sides of the support member 15 of the valve module 13 shown in FIG. 6B.

Figure 6D:
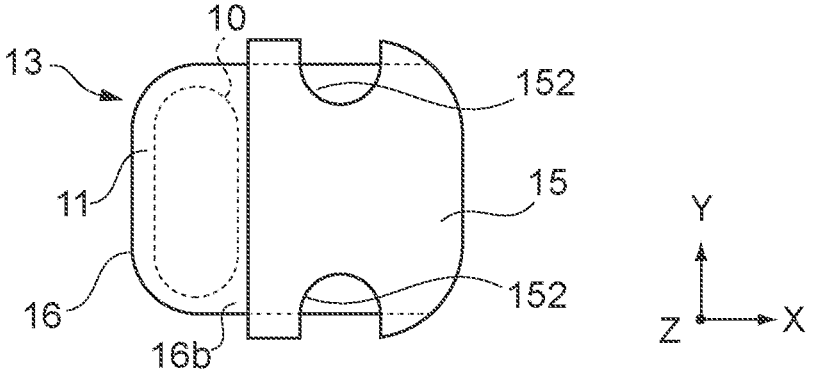

The support member 15 of the valve module 13 shown in FIG. 6D has a shape in which cutouts 152 are provided at a pair of opposite sides of the support member 15 of the valve module 13 shown in FIG. 6A.

Figure 7A:
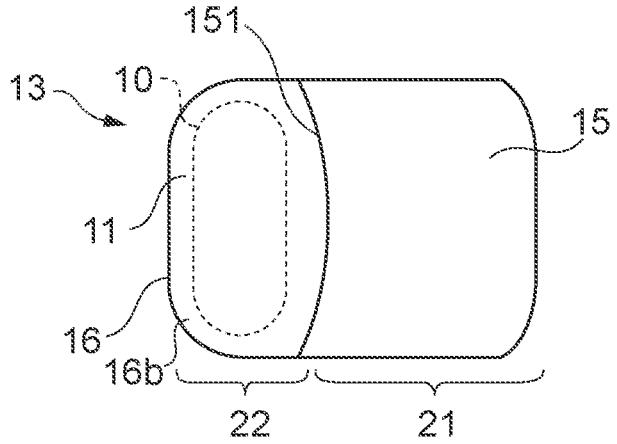
FIGS. 7A, 7B, and 7C Plan views of valve modules in still other shape examples.
Figure 7B:
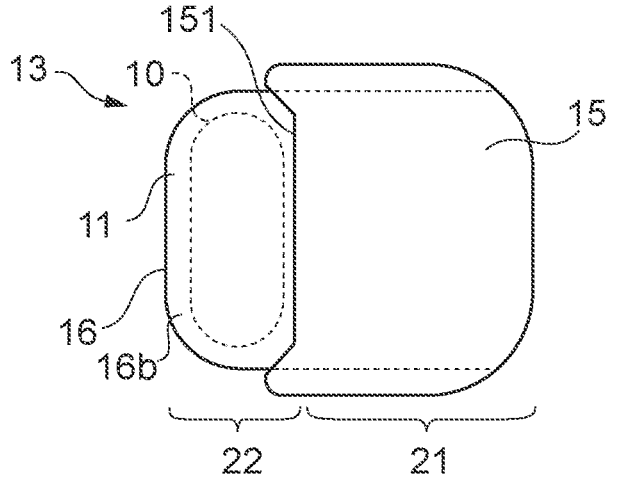
Figure 7C:
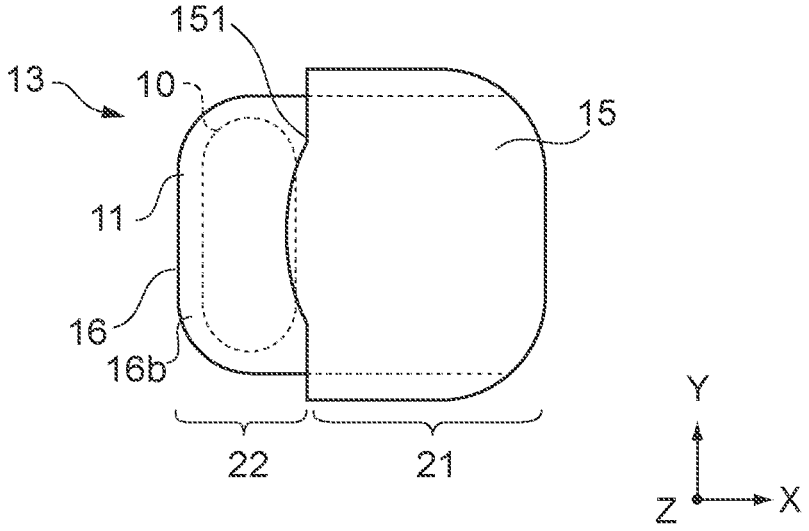

FIGS. 7A, 7B, and 7C are examples in which the shapes of the support member 15 and the movable member 16 are different from those of the valve module shown in FIGS. 3A and 3B. With all the valve modules 13, the support member 15 covers the second surface 16*b* of the part of the movable member 16.

The support member 15 and the movable member 16 of the valve module 13 shown in FIGS. 3A and 3B have a substantially semi-elliptical shape in the planar view. Moreover, in the valve module 13 shown in FIGS. 3A and 3B, the end portion 151 of the support member 15 that defines the boundary between the overlapping region 21 and the non-overlapping region 22 has a straight line shape.

In contrast, the movable members 16 of the valve modules 13 shown in FIGS. 7A, 7B, and 7C all have a rectangular shape with round corners.

In the support member 15 of the valve module 13 shown in FIG. 7A, the end portion 151 has a smooth curve line shape projecting toward the overlapping region 21 in the planar view.

The support member 15 of the valve module 13 shown in FIG. 7B has a shape including a portion projecting from the movable member 16 in the Y-axis direction. In addition, the support member 15 shown in FIG. 7B has a shape in which the end portion 151 has a curve line-shaped portion projecting toward the overlapping region 21 in the planar view. The end portion 151 is in a shape including projections at both lateral portions in the Y-axis direction.

The support member 15 of the valve module 13 shown in FIG. 7C has a shape in which the center portion of the end portion 151 in the Y-axis direction has a curve line-shaped portion projecting toward the non-overlapping region 22 in the planar view. Moreover, a part of the support member 15 and the opening 10 overlap each other in the planar view.

Figure 8A:
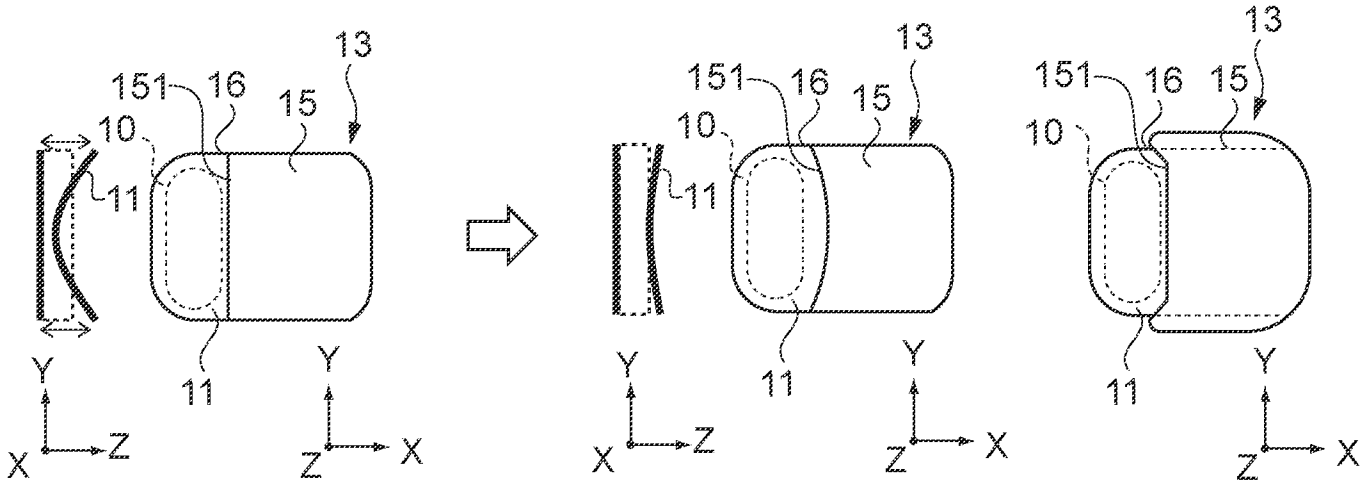
FIGS. 8A and 8B Diagrams describing effects of shape differences of support members in the valve modules shown in FIGS. 7A, 7B, and 7C.
Figure 8B:
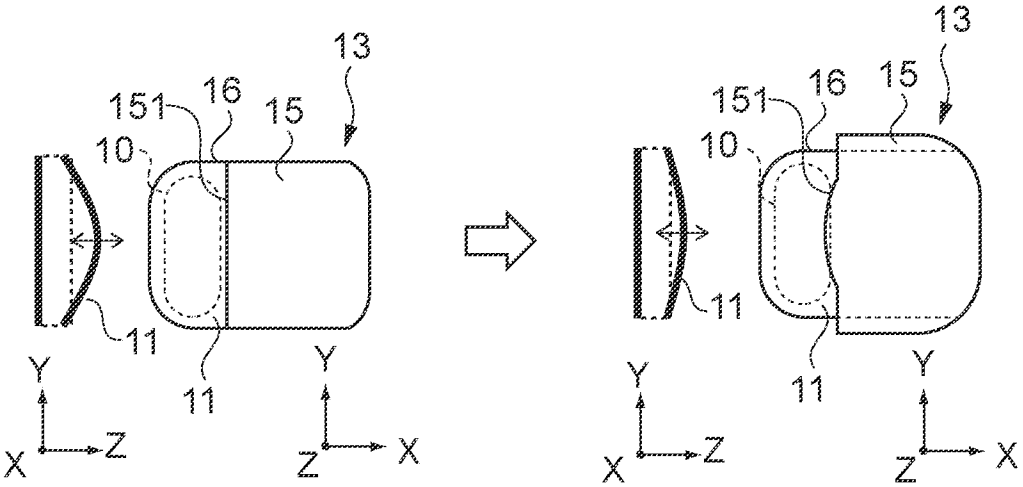

FIGS. 8A and 8B are diagrams for describing an effect due to the different shapes of the end portions 151 of the support members 15 of the valve modules shown in FIGS. 7A, 7B, and 7C.

In each drawing, views located on the left side of the arrows are a plan view of the valve module 13 of the support member 15, the end portion 151 of which has the straight line shape, and a schematic cross-sectional view for describing the movement of the movable valve 11 in a case where the valve module 13 is mounted on the fluid control apparatus main body and the fluid is transported.

In each drawing, views located on the right side of the arrows are a plan view of the valve module 13 including the support member 15, the end portion 151 of which has a shape projecting toward the overlapping region 21 or the non-overlapping region 22, and a schematic cross-sectional view for describing the movement of the movable valve 11 in a case where the valve module 13 is mounted on the fluid control apparatus main body and the fluid is transported.

In FIG. 8A, two valve modules 13 shown on the right side of the arrow are the valve modules 13 shown in FIGS. 7A and 7B.

In FIG. 8B, the valve module 13 shown on the right side of the arrow is the valve module 13 shown in FIG. 7C.

In the valve module 13 shown on the left side of the arrow of FIG. 8A, it is assumed that the movable valve 11 does move uniformly in the Z-axis direction in the Y-axis direction when the valve is opened, and the movable valve 11 is displaced so that the center portion in the Y-axis direction is depressed in the Z-axis direction.

In such a case, as shown on the right side of the arrow of FIG. 8A, the end portion 151 of the support member 15 is set to have a shape in which the center portion in the Y-axis direction projects toward the overlapping region 21 in the planar view. Accordingly, when the valve is opened, the degree of depression in the Z-axis direction at the center portion in the Y-axis direction of the movable valve 11 is reduced, and the displacement attitude of the movable valve 11 can be adjusted so that the movable valve 11 is displaced substantially uniformly in the Z-axis direction in the Y-axis direction.

Moreover, in the valve module 13 shown on the left side of the arrow of FIG. 8B, it is assumed that the movable valve 11 does not move uniformly in the Z-axis direction in the Y-axis direction when the valve is opened, and the movable valve 11 is displaced so that the center portion in the Y-axis direction protrudes in the Z-axis direction.

In such a case, as shown on the right side of the arrow of FIG. 8B, the end portion 151 of the support member 15 is set to have a shape in which the center portion in the Y-axis direction projects toward the overlapping region 21 in the planar view. Accordingly, when the valve is opened, the degree of protruding in the Z-axis direction at the center portion in the Y-axis direction of the movable valve 11 is reduced, and the displacement attitude of the movable valve 11 can be adjusted so that the movable valve 11 moves substantially uniformly in the Z-axis direction in the Y-axis direction.

By changing the shape of the end portion 151 of the support member 15 that defines the boundary between the overlapping region 21 and the non-overlapping region 22 in this manner, the displacement attitude of the movable valve 11 of the valve module 13 during the operation of the fluid control apparatus 1 can be adjusted.

In this embodiment, the valve module 13 is configured separately from the respective plate-like members in the fluid control apparatus 1, and therefore the displacement attitude of such a movable valve 11 can be adjusted for each of the valve modules 13. Thus, a suitable valve module 13 can be disposed in each fluid control apparatus 1, in each opening 10, and fluid control apparatuses 1 having an excellent fluid transporting characteristic can be stably fabricated.

Moreover, although the example in which one valve module 13 is provided with respect to one opening 10 has been described hereinabove, one valve module 13 may be provided with respect to a plurality of openings 10. Hereinafter, an example of a valve module 13 provided corresponding to two openings 10 will be described using FIGS. 9A, 9B, and 9C. It should be noted that the number of openings 10 is not limited, and may be three or more. Accordingly, for example, in the fluid control apparatus in which the plurality of openings 10 is positioned in proximity to each other, the number of components of the valve module 13 can be reduced by using the valve module 13 shown in FIGS. 9A, 9B, and 9C.

Figure 9A:
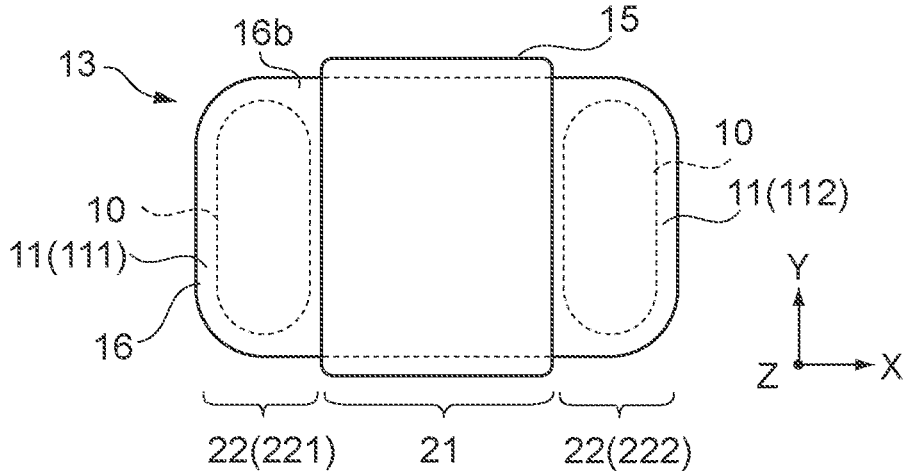
FIGS. 9A, 9B, and 9C Plan views of valve modules in still other shape examples.

The valve module 13 shown in FIG. 9A includes a movable member 16 and a support member 15 that covers a part of the second surface 16*b* of the movable member 16. The support member 15 and the movable member 16 each have a substantially rectangular shape. The support member 15 is stacked and disposed extending across the center portion of the movable member 16 in the X-axis direction in the Y-axis direction and the support member 15 is not located in both side portions of the movable member 16 in the X-axis direction.

The valve module 13 shown in FIG. 9A includes, in the planar view, an overlapping region 21 in which the support member 15 and the movable member 16 overlap each other and non-overlapping regions 22 in which the support member 15 is not stacked and only the movable member 16 is positioned. In addition, the non-overlapping region 22 includes a first non-overlapping region 221 and a second non-overlapping region 222 that are positioned in opposite to each other in the X-axis direction with the overlapping region 21 between the first non-overlapping region 221 and the second non-overlapping region 222. The first non-overlapping region 221 constitutes a first movable valve 111 and the second non-overlapping region 222 constitutes a second movable valve 112. In a case where it is not particularly necessary to especially distinguish them as the first movable valve 111 and the second movable valve 112, they will be referred to as the movable valves 11 and described. Hereinafter, the same applies to the descriptions of FIGS. 9B and 9C.

The first non-overlapping region 221 and the second non-overlapping region 222 are positioned overlapping the two different openings 10 in the planar view, respectively. The first non-overlapping region 221 that constitutes the first movable valve 111 and the second non-overlapping region 222 that constitutes the second movable valve 112 are each independently elastically deformable.

A length (projection length) in the X-axis direction of each of the first movable valve 111 and the second movable valve 112 is easily set to have an arbitrary dimension depending on the size and arrangement position of the support member 15 or the shape of the movable member 16. Therefore, adjustment can be performed to make the first movable valve 111 and the second movable valve 112 suitable for the respective openings 10.

Figure 9B:
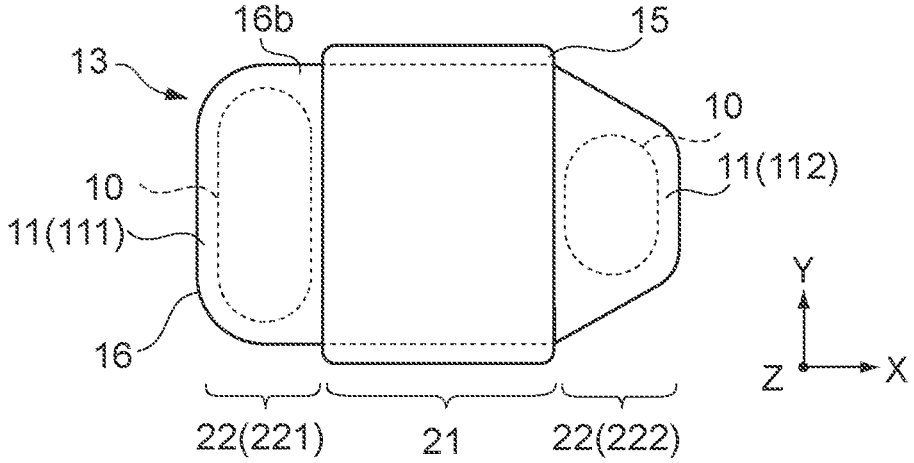

The valve module 13 shown in FIG. 9B includes a movable member 16 and a support member 15 that covers a part of the second surface 16*b* of the movable member 16. The support member 15 has a substantially rectangular shape and the movable member 16 has a substantially hexagonal shape. The support member 15 is disposed extending across the center portion of the movable member 16 in the X-axis direction in the Y-axis direction and the support member 15 is not located in both side portions of the movable member 16 in the X-axis direction.

The valve module 13 shown in FIG. 9B includes, in the planar view, an overlapping region 21 in which the support member 15 and the movable member 16 overlap each other and non-overlapping regions 22 in which the support member 15 is not stacked and only the movable member 16 is positioned. In addition, the non-overlapping region 22 includes a first non-overlapping region 221 and a second non-overlapping region 222 that are positioned in opposite to each other the X-axis direction with the overlapping region 21 between the first non-overlapping region 221 and the second non-overlapping region 222.

The first non-overlapping region 221 and the second non-overlapping region 222 are positioned overlapping the two different openings 10 in the planar view, respectively. The first non-overlapping region 221 that constitutes first movable valve 111 and the second non-overlapping region 222 that constitutes the second movable valve 112 are each independently elastically deformable.

In this example, the first non-overlapping region 221 and the second non-overlapping region 222 have different areas and the opening 10 corresponding to the first non-overlapping region 221 and the opening 10 corresponding to the second non-overlapping region 222 also have different opening shapes and opening areas.

By changing the areas of the first non-overlapping region 221 and the second non-overlapping region 222 in this manner, the flow rate of the fluid that moves through each opening 10 and the response characteristics of the movable valve 11 can be changed and can be adjusted to make the first movable valve 111 and the second movable valve 112 suitable for the respective openings 10.

Figure 9C:
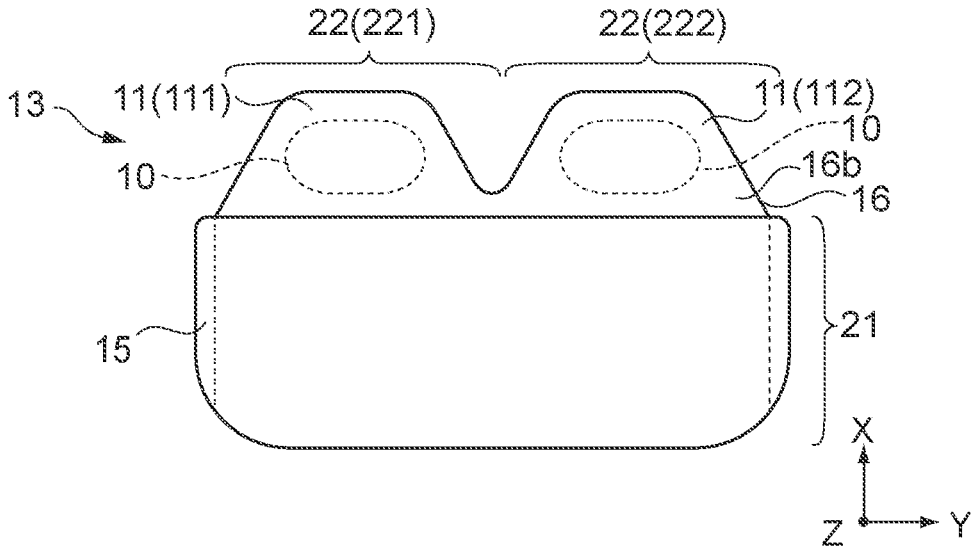

In FIGS. 9A and 9B, the examples in which the first non-overlapping region 221 and the second non-overlapping region 222 are arranged in opposite to each other with the overlapping region 21 between the first non-overlapping region 221 and the second non-overlapping region 222 have been shown, the first non-overlapping region 221 and the second non-overlapping region 222 may be located next to each other as shown in FIG. 9C.

The valve module 13 shown in FIG. 9C includes a movable member 16 and a support member 15 that covers a part of the second surface 16*b* of the movable member 16. The support member 15 has a substantially rectangular shape. The movable member 16 has a shape in which two projections are located next to each other form one side of the substantially rectangle and the support member 15 is positioned covering a portion other than the two projections of the movable member 16.

The valve module 13 shown in FIG. 9C includes, in the planar view, an overlapping region 21 in which the support member 15 and the movable member 16 overlap each other and non-overlapping regions 22 in which the support member 15 is not stacked and only the movable member 16 is positioned. In addition, the non-overlapping region 22 includes a first non-overlapping region 221 and a second non-overlapping region 222 that are located next to each other in the Y-axis direction. The two projections in the movable member 16 constitute the first non-overlapping region 221 and the second non-overlapping region 222, respectively.

The first non-overlapping region 221 and the second non-overlapping region 222 are positioned overlapping the two different openings 10 in the planar view, respectively. The first non-overlapping region 221 that constitutes first movable valve 111 and the second non-overlapping region 222 that constitutes the second movable valve 112 are each independently elastically deformable.

A length (projection length) in the X-axis direction of each of the first non-overlapping region 221 and the second non-overlapping region 222 is easily set to have an arbitrary dimension depending on the shape of the support member 15 and the shape of the movable member. Accordingly, adjustment can be performed to make the first movable valve 111 and the second movable valve 112 suitable for the respective openings 10.

[Manufacturing Method of Valve Module]

Next, a manufacturing method of the valve module 13 will be described.

FIGS. 10A, 10B, 10C, and 10D are diagrams describing the manufacturing method of the valve module 13.

Figure 11:
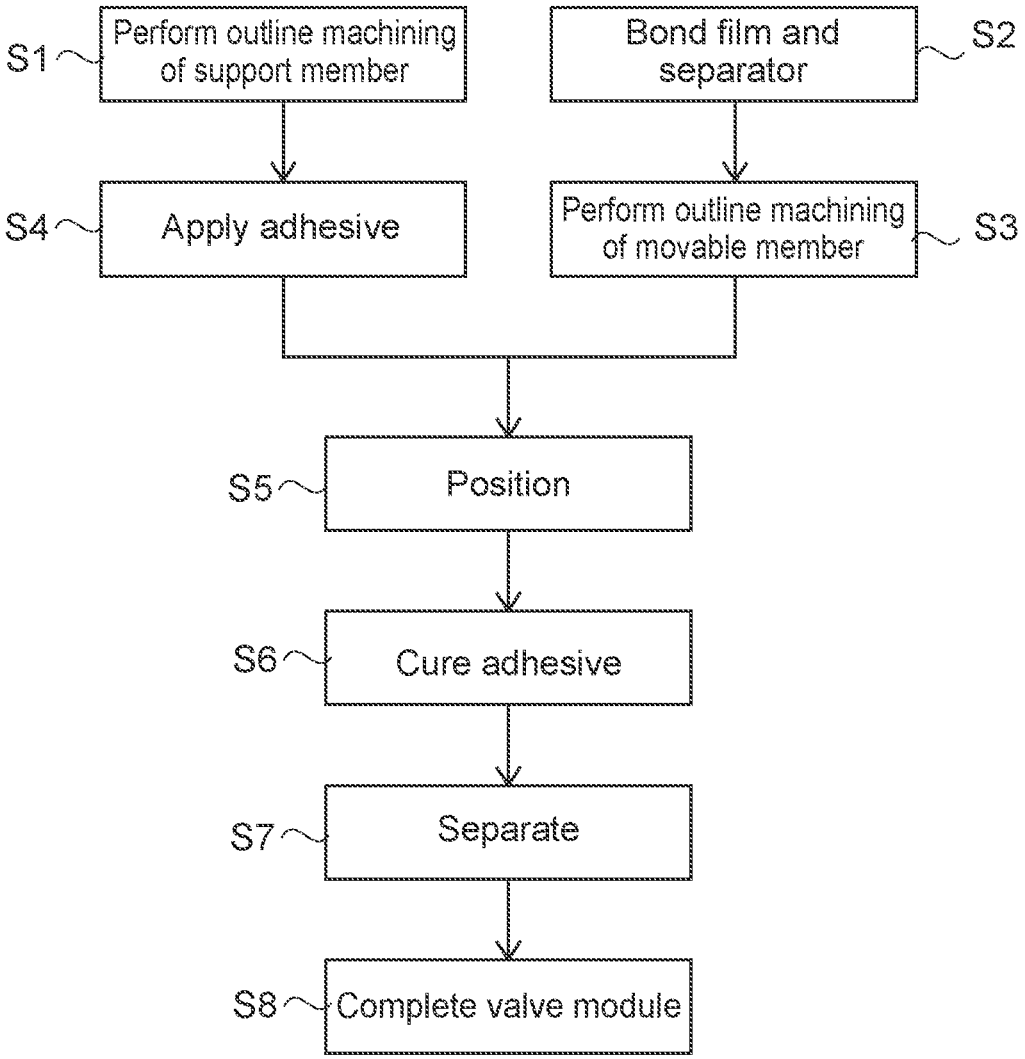
FIG. 11 A manufacturing process diagram of the valve module.

FIG. 11 is a manufacturing process diagram of the valve module 13.

Hereinafter, the description will be given using FIGS. 10A, 10B, 100, and 10D, following the flow of FIG. 11. Hereinafter, an example in which stainless steel is used for the material of the support member 15 and a polyimide film is used for the material of the movable member 16 has been shown.

Figure 10A:
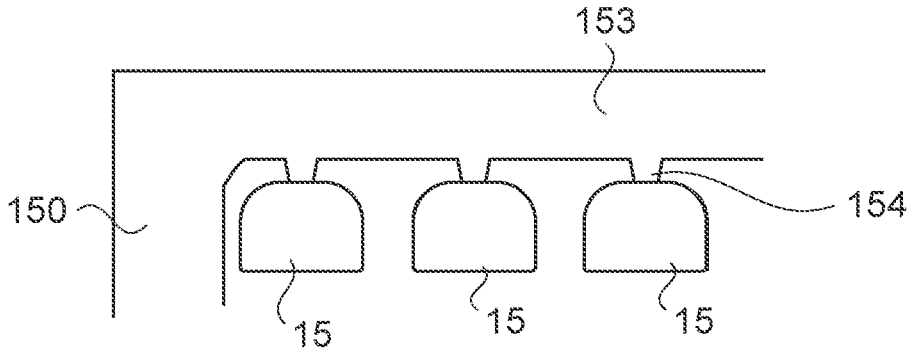
FIGS. 10A, 10B, 10C, and 10D Diagrams describing a manufacturing method of the valve module.

As shown in FIG. 10A, a stainless-steel film 150 is machined into a shape in which support members 15 are connected to a frame portion 153 via thin shaft portions 154 by etching or the like (S1). In the single stainless-steel film 150, a plurality of support members 15 are arranged at predetermined pitches and connected.

Figure 10B:
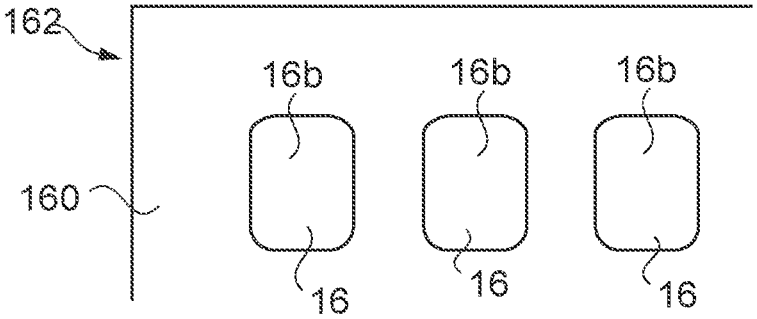

As shown in FIG. 10B, a substrate 162 is formed (S2) by bonding a separator (not shown) and a polyimide film 160 with each other, the polyimide film 160 is cut into outer shapes of the plurality of movable members 16, and outline machining of the movable member 16 is performed (S3). In the single substrate 162, the plurality of movable members 16 is disposed at the same pitches as the pitches of the plurality of support members 15 in the stainless-steel film 150.

Next, an adhesive is applied to each support member 15 of the stainless-steel film 150 in the state in which the plurality of support members 15 is connected (S4).

Figure 10C:
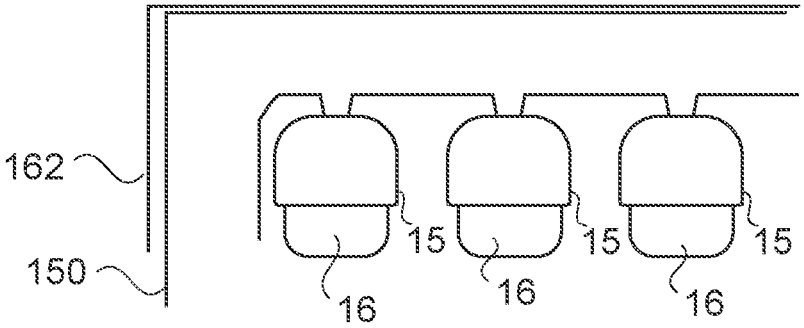

Next, as shown in FIG. 10C, the stainless-steel film 150 is positioned and disposed on the substrate 162 with the surface to which the adhesive has been applied facing down (S5). For example, here, the stainless-steel film 150 and the substrate 162 are set to have a rectangular shape with the same outer shape dimension, and outline machining of the support member 15 and the movable member 16 is performed in the stainless-steel film 150 and the substrate 162, respectively, so that the movable member 16 and the support member 15 can be positioned by bringing the respective corners into contact with each other.

By changing the areas of the first non-overlapping region 221 and the second non-overlapping region 222 in this manner, the flow rate of the fluid that moves through each opening 10 and the response characteristics of the movable valve 11 can be changed and can be adjusted to make the first movable valve 111 and the second movable valve 112 suitable for the respective openings 10.

In FIGS. 9(A) and (B), the examples in which the first non-overlapping region 221 and the second non-overlapping region 222 are arranged in opposite to each other with the overlapping region 21 between the first non-overlapping region 221 and the second non-overlapping region 222 have been shown, the first non-overlapping region 221 and the second non-overlapping region 222 may be located next to each other as shown in FIG. 9(C).

The valve module 13 shown in FIG. 9(C) includes a movable member 16 and a support member 15 that covers a part of the second surface 16*b* of the movable member 16. The support member 15 has a substantially rectangular shape. The movable member 16 has a shape in which two projections are located next to each other form one side of the substantially rectangle and the support member 15 is positioned covering a portion other than the two projections of the movable member 16.

The valve module 13 shown in FIG. 9(C) includes, in the planar view, an overlapping region 21 in which the support member 15 and the movable member 16 overlap each other and non-overlapping regions 22 in which the support member 15 is not Next, in the state in which the stainless-steel film 150 and the substrate 162 are fixed via the adhesive, the adhesive is cured and the adhesive layer 14 is obtained (S6). Accordingly, the plurality of valve modules 13 is formed in series.

Figure 10D:
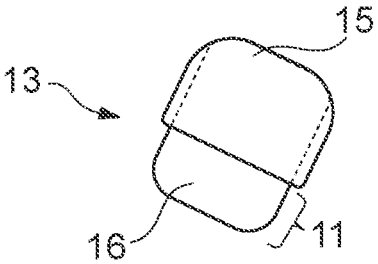

Next, as shown in FIG. 10D, the thin shaft portions 154 are cut and the plurality of valve modules 13 is separated from each other (S7), and the separator is pealed and the valve module 13 is completed (S8).

As described above, since the stainless-steel film including the plurality of support members subjected to outline machining with a desired precision and the substrate including the plurality of movable members subjected to outline machining with a desired precision are positioned as bunches and they are separated after they are bonded to each other, the plurality of valve modules 13 can be fabricated at once, which is efficient.

[Implementation Method of Valve Module]

Next, a method of mounting the valve module 13 on the fluid control apparatus main body and fabricating the fluid control apparatus 1 will be described.

Figure 12:
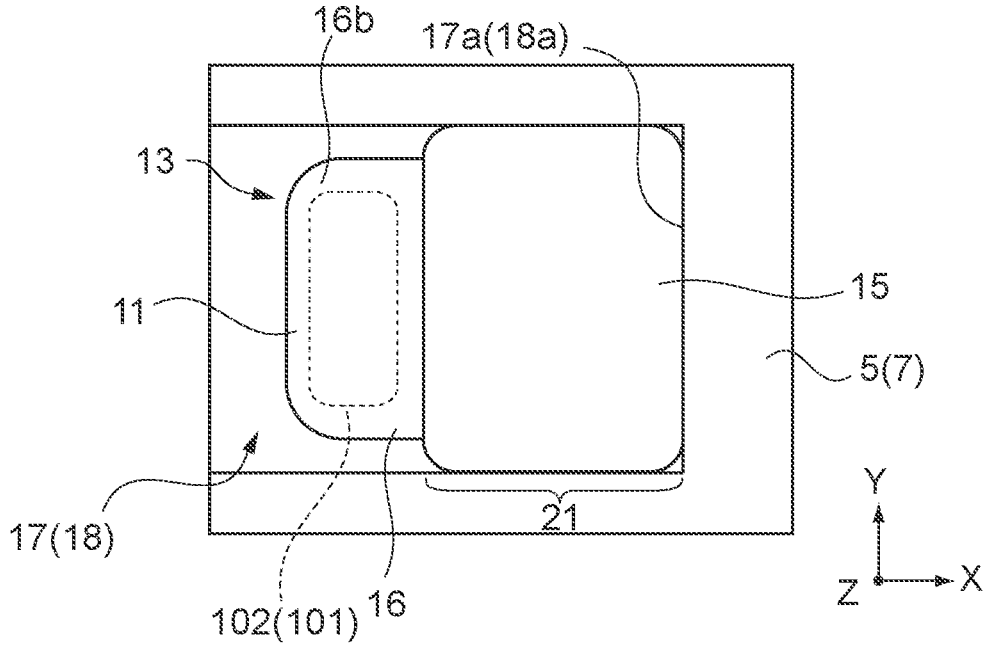
FIG. 12 A plan view of the periphery of the valve module for describing positioning at the time of mounting of the valve module.

FIG. 12 is a plan view describing a state of positioning with respect to the third member 5 (fifth member 7) of the valve module 13 at the time of mounting of the valve module 13.

Figure 13:
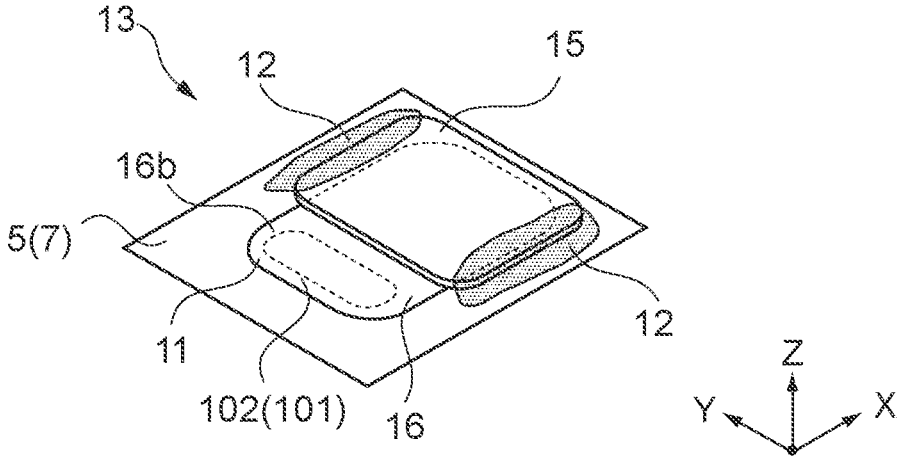
FIG. 13 A perspective view of the periphery of the valve module for describing a state of arrangement of adhesives at the time of mounting of the valve module.

FIG. 13 is a perspective view in the periphery of the valve module describing an example of mounting on the third member 5 (fifth member 7) of the valve module 13.

Figure 14:
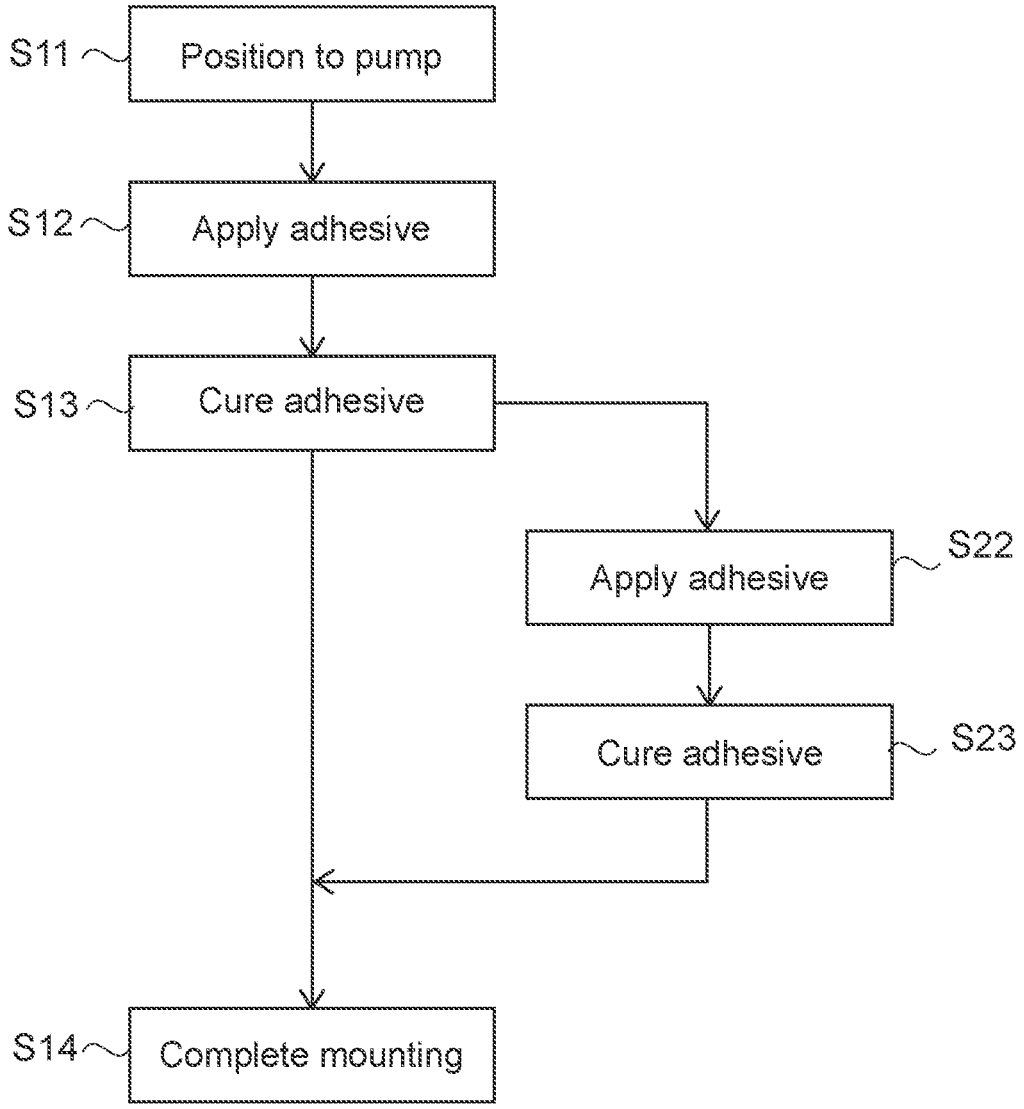
FIG. 14 A manufacturing process diagram of the valve module on the fluid control apparatus.

FIG. 14 is a manufacturing process diagram of the valve module 13.

Hereinafter, the description will be given using FIGS. 12 and 13 in accordance with the flow of FIG. 14.

As shown in FIG. 12, the valve module 13 is arranged inside the recess portion 17 (18) provided in the third member 5 (fifth member 7) and positioning is performed so that the support member 15 of the valve module 13 is brought into contact with the inner surface 17*a* (18*a*) (S11).

In the example shown in FIG. 12, the dimension in the Y-axis direction of the recess portion 17 (18) is substantially the same as the dimension in the Y-axis direction of the valve module 13, and positioning of the valve module 13 in the Y-axis direction can be easily performed. In addition, positioning can be easily performed by disposing the valve module 13 inside the recess portion 17 (18) in the X-axis direction and sliding the valve module 13 until the valve module 13 comes into contact with the inner surface 17*a* (18*a*) in the X-axis direction.

Next, as shown in FIG. 13, adhesives 12 are applied to the support member 15 and the third member 5 (fifth member 7), over respective ones of a pair of opposite sides extending in the X-axis direction of the substantially rectangular support member 15 of the valve module 13 (S12) and the adhesives 12 are cured (S13). In this manner, the support member 15 functions as a coupling member that the valve module 13 and the fluid control apparatus are coupled with each other. For the adhesives 12, a well-known material can be used, and, for example, an epoxy-adhesive, a cyanoacrylate adhesive, an ultraviolet curing adhesive, or the like can be used as the adhesives 12.

Accordingly, mounting of the fluid control apparatus main body onto the valve module 13 is completed (S14).

It should be noted that in a case where it is necessary to reinforce the adhesion portion, steps of applying (S22) the adhesives 12 again after S13 and curing (S23) the adhesives 12 may be added.

By providing the recess portion to be the mounting portion and performing positioning by utilizing the outer shape of the valve module in this manner, the machining efficiency is enhanced.

It should be noted that positioning of the movable valve 11 and the openings 10 can also be performed using image processing other than positioning utilizing such an outer shape.

[Arrangement Example of Adhesives]

FIGS. 15A and 15B are diagrams describing an arrangement example of the adhesives 12.

FIGS. 15A and 15B are partial schematic cross-sectional views of fluid control apparatuses 31 and 53. As compared to the fluid control apparatus 1 shown in FIG. 1, regarding the fluid control apparatuses 31 and 53 shown in FIGS. 15A and 15B, the number and the like of drive mechanisms 4, intake ports 101, and exhaust ports 102 are mainly different and the point that the plate-like members have been stacked is the same, and the same applies to fluid control apparatuses to be described later shown in FIGS. 17 to 22.

The fluid control apparatus 31 shown in FIG. 15A includes a first member 32, a second member 33, a third member 35 having a vibration portion 351 and a fixed portion 352, a drive mechanism 4 such as a piezoelectric element disposed corresponding to the vibration portion 351, a fourth member 36, a fifth member 37, one intake port 101, one exhaust port 102, and valve modules 13 provided in the intake port 101 and the exhaust port 102, respectively.

In the fluid control apparatus 31 shown in FIG. 15A, the third member 35, the fourth member 36, and the fifth member 37 form a space 19. Moreover, the intake ports 101 and the exhaust ports 102 are provided in the fixed portion 352 of the third member 35. In the drawing, the valve module 13 provided in the intake port 101 is provided on the surface positioned under the third member 35. The valve module 13 provided in the exhaust port 102 is provided on the surface positioned above the third member 35.

As shown in FIG. 15, the adhesives 12 may be positioned only on the third member 35.

A fluid control apparatus 53 shown in FIG. 15B includes a first member 54, a second member 55, a third member 56 having a vibration portion 561 and a fixed portion 562, a drive mechanism 4 such as a piezoelectric element disposed corresponding to the vibration portion 561, a fourth member 57, a fifth member 58, one intake port 101, one exhaust port 102, and valve modules 13 provided in the intake port 101 and the exhaust port 102, respectively.

In the fluid control apparatus 53 shown in FIG. 15B, the third member 56, the fourth member 57, and the fifth member 58 form a space 19. Moreover, the intake port 101 and the exhaust port 102 are provided in the fixed portion 562 of the third member 56. In the drawing, the valve module 13 provided in the intake ports 101 is provided on the surface positioned under the third member 56. The valve module 13 provided in the exhaust ports 102 is provided on the surface positioned above the third member 56.

A through-hole 541 is provided in a part of a region of the first member 54, which is opposite to the fixed portion 562 of the third member 56. A through-hole 581 is provided in a part of a region of the fifth member 58, which is opposite to the fixed portion 562 of the third member 56. The through-holes 541 and 581 are provided corresponding to the valve modules 13, respectively.

As shown in FIG. 15B, the adhesives 12 may be positioned to extend in the Z-axis direction between the first member 54 and the third member 56 and between the third member 56 and the fifth member 58, which can improve the adhesion strength of the valve modules 13. In addition, the through-holes 541 and 581 may be also filled with the adhesives 12, which can further improve the adhesion strength of the valve modules 13.

[Other Shape Examples of Valve Module and Recess Portion]

In the valve module 13 shown in FIG. 12, the dimension in the Y-axis direction of the support member 15 has a uniform shape in the X-axis direction, though as in a valve module 13 shown in FIG. 16, it may have a different portion in the X-axis direction.

The support member 15 of the valve module 13 shown in FIG. 16 has a shape in which one end portion in the X-axis direction has a convex portion 155 projecting outward in the Y-axis direction. In the portion of the support member 15 in which the convex portion 155 is positioned, the dimension in the Y-axis direction is larger than the portion of the support member 15 in which the convex portion 155 is not located. The recess portion (18) corresponding to the outer shape of the support member 15 is provided in the third member 5 (fifth member 7). Due to such a shape, when positioning the valve module 13 to the third member 5 (fifth member 7), positioning in the X-axis direction and the Y-axis direction can be easily performed using the outer shape of the support member 15.

[Another Configuration Example of Fluid Control Apparatus]

The respective number of drive mechanisms 4, intake ports 101, and exhaust ports 102 and the arrangement positions of the intake ports 101 and the exhaust ports 102 are not limited to the examples described in the fluid control apparatuses 1, 31, and 53. For example, the configurations respectively shown in FIGS. 17 to 21 may be used therefor.

Figure 17:
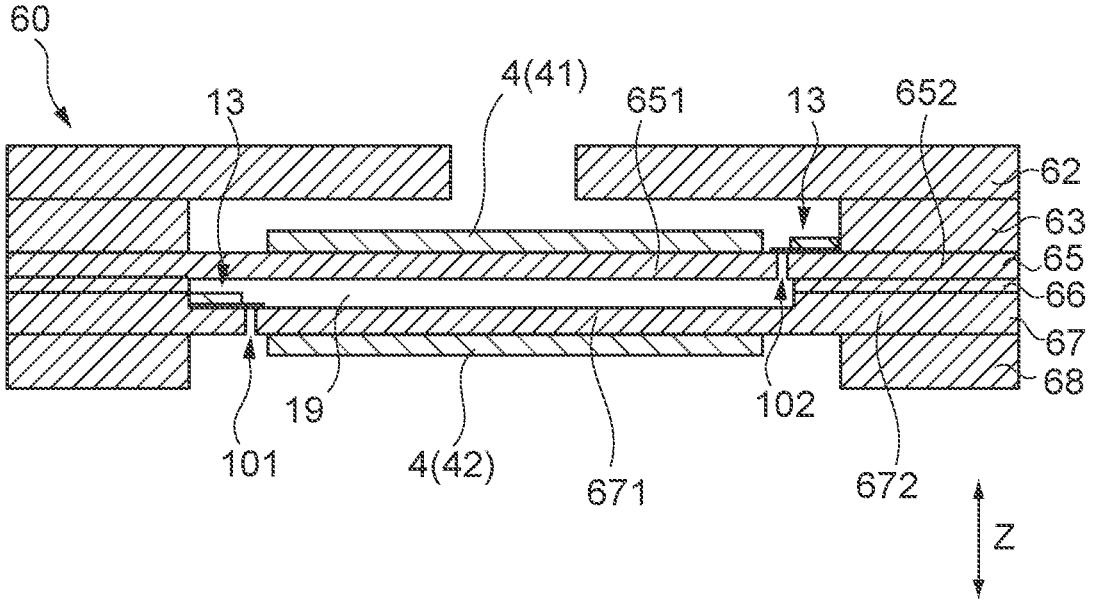
FIG. 17 A partial schematic cross-sectional view of a fluid control apparatus in another example.

A fluid control apparatus 60 shown in FIG. 17 includes two drive mechanisms 4, one intake port 101, and one exhaust port 102.

The fluid control apparatus 60 shown in FIG. 17 includes a first member 62, a second member 63, a third member 65 having a vibration portion 651 and a fixed portion 652, a fourth member 66, a fifth member 67 having a vibration portion 671 and a fixed portion 672, a sixth member 68, a first drive mechanism 41, a second drive mechanism 42, one intake port 101, one exhaust port 102, and valve modules 13 provided in the intake port 101 and the exhaust port 102, respectively. The first to sixth members are plate-like members.

In the fluid control apparatus 60 shown in FIG. 17, the third member 65, the fourth member 66, and the fifth member 67 form a space 19. Moreover, the exhaust port 102 is provided in the fixed portion 652 of the third member 65 and the intake ports 101 is provided in the fixed portion 672 of the fifth member 67. The first drive mechanism 41 is positioned in the vibration portion 651 above the third member 65. The second drive mechanism 42 is positioned below the fifth member 67, held in contact with the vibration portion 671.

Figure 18:
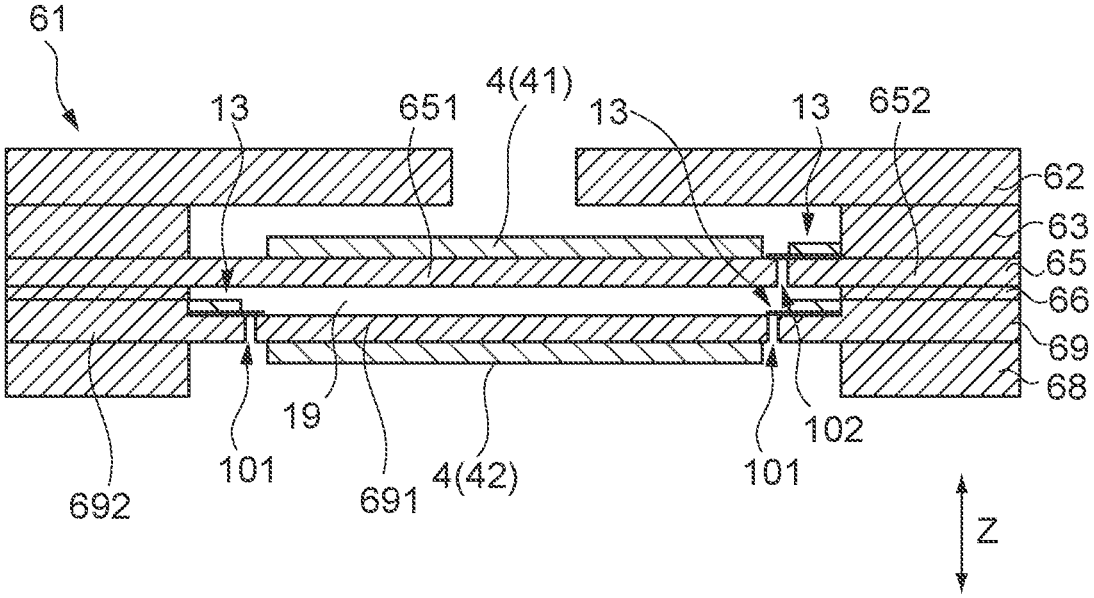
FIG. 18 A partial schematic cross-sectional view of a fluid control apparatus in still another example.

A fluid control apparatus 61 shown in FIG. 18 includes two drive mechanisms 4, two intake ports 101, and one exhaust port 102. The configuration similar to the fluid control apparatus 60 shown in FIG. 17 will be denoted by similar reference signs.

The fluid control apparatus 61 shown in FIG. 18 includes a first member 62, a second member 63, a third member 65 having a vibration portion 651 and a fixed portion 652, a fourth member 66, a fifth member 69 having a vibration portion 691 and a fixed portion 692, a sixth member 68, a first drive mechanism 41, a second drive mechanism 42, the two intake ports 101, the one exhaust port 102, valve modules 13 provided in the intake ports 101 and the exhaust port 102, respectively. The first to sixth members are plate-like members.

In the fluid control apparatus 61 shown in FIG. 18, the third member 65, the fourth member 66, and the fifth member 69 form a space 19. Moreover, the one exhaust port 102 is provided in the fixed portion 652 of the third member 65 and the two intake ports 101 are provided in the fixed portion 692 of the fifth member 69. The first drive mechanism 41 is positioned above the third member 65, held in contact with the vibration portion 651. The second drive mechanism 42 is positioned, held in contact with the vibration portion 691 below the fifth member 69.

Figure 19:
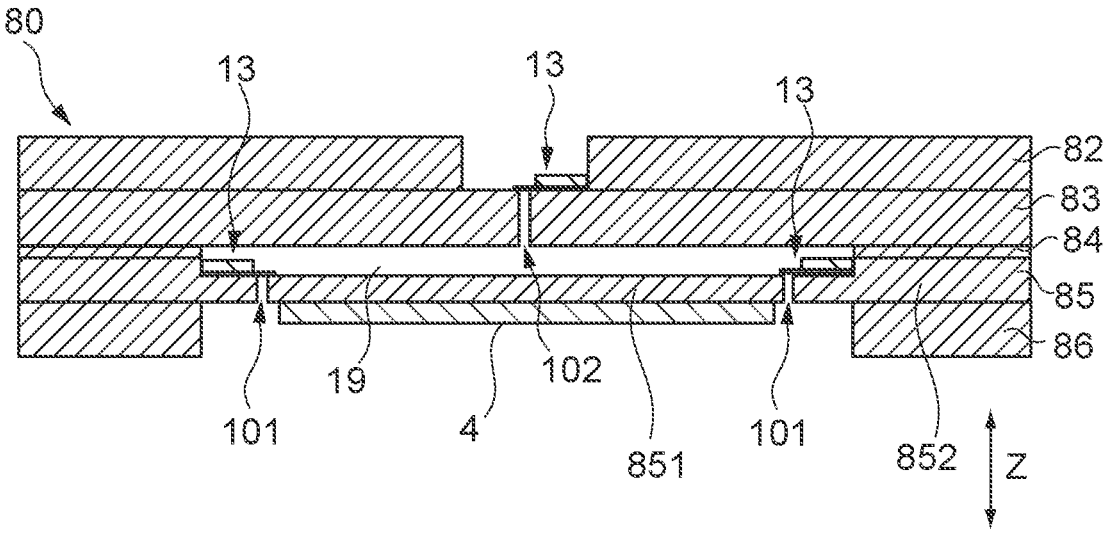
FIG. 19 A partial schematic cross-sectional view of a fluid control apparatus in still another example.

A fluid control apparatus 80 shown in FIG. 19 includes one drive mechanism 4, two intake ports 101, and one exhaust port 102.

The fluid control apparatus 80 shown in FIG. 19 includes a first member 82, a second member 83, a third member 84, a fourth member 85 having a vibration portion 851 and a fixed portion 852, a fifth member 86, a drive mechanism 4, the two intake ports 101, the one exhaust port 102, and valve modules 13 provided in the intake ports 101 and the exhaust port 102, respectively. The first to fifth members are plate-like members.

In the fluid control apparatus 80 shown in FIG. 19, the second member 83, the third member 84, and the fourth member 85 form a space 19. Moreover, the two intake ports 101 are provided in the fixed portion 852 of the fourth member 85 and the one exhaust port 102 is provided in the center portion of the second member 83. The drive mechanism 4 is positioned below the fourth member 85, held in contact with the vibration portion 851. The exhaust port 102 is located in opposite to the center portion of the vibration portion 851 in the planar view.

Figure 20:
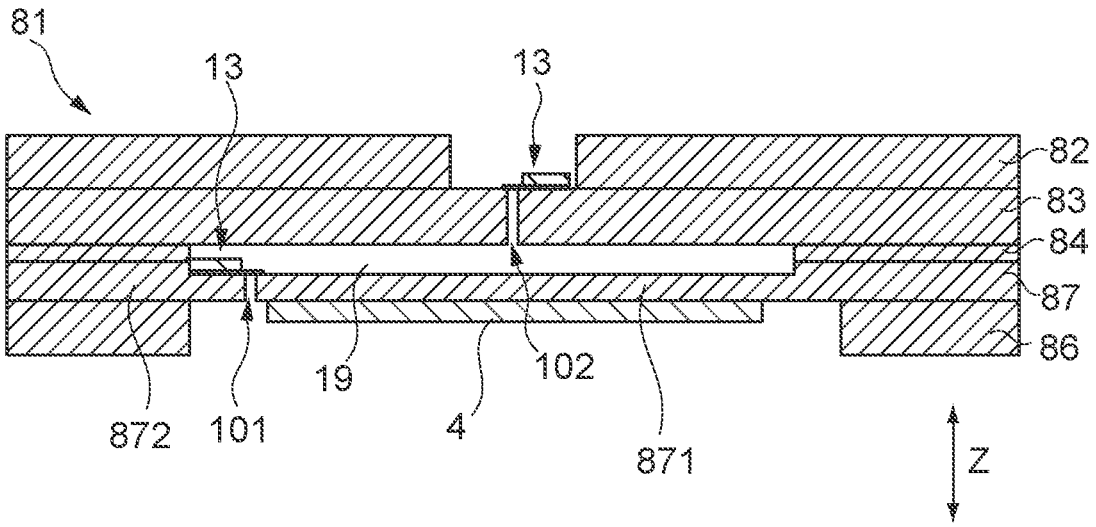
FIG. 20 A partial schematic cross-sectional view of a fluid control apparatus in still another example.

A fluid control apparatus 81 shown in FIG. 20 includes one drive mechanism 4, one intake port 101, and one exhaust port 102. Configurations similar to those of the fluid control apparatus 80 shown in FIG. 19 will be denoted by similar reference signs.

The fluid control apparatus 81 shown in FIG. 20 includes a first member 82, a second member 83, a third member 84, a fourth member 87 having a vibration portion 871 and a fixed portion 872, a fifth member 86, a drive mechanism 4, the one intake port 101, the one exhaust port 102, and valve modules 13 provided in the intake port 101 and the exhaust port 102, respectively. The first to fifth members are plate-like members.

In the fluid control apparatus 81 shown in FIG. 20, the second member 83, the third member 84, and the fourth member 87 form a space 19. Moreover, the one intake port 101 is provided in the fixed portion 872 of the fourth member 87 and one exhaust port 102 is provided in the center portion of the second member 83. The drive mechanism 4 is positioned below the fourth member 87, held in contact with the vibration portion 871. The exhaust ports 102 is located in opposite to the center portion of the vibration portion 871 in the planar view.

Figure 21:
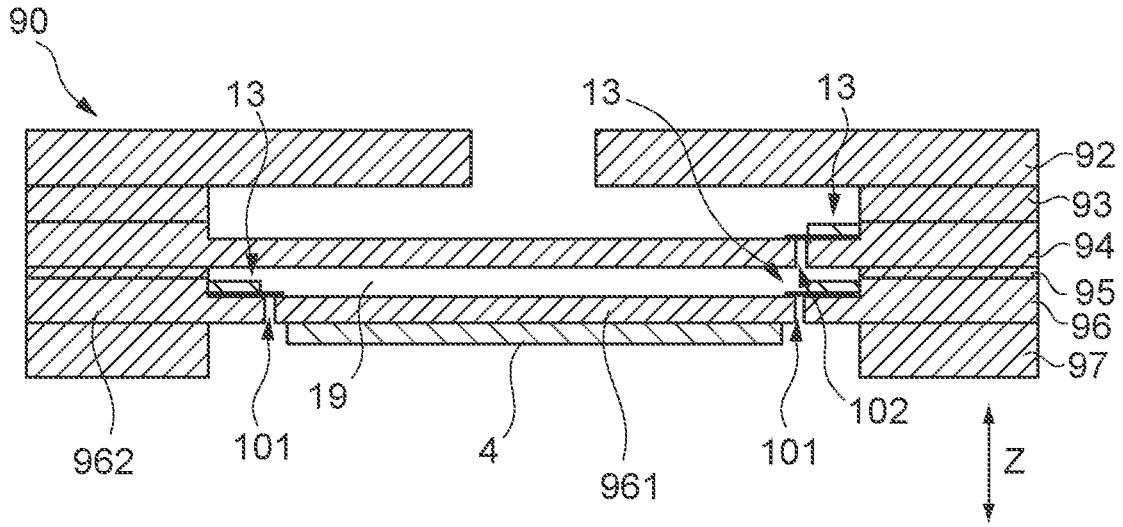
FIG. 21 A partial schematic cross-sectional view of a fluid control apparatus in still another example.

A fluid control apparatus 90 shown in FIG. 21 includes one drive mechanism 4, two intake ports 101, and one exhaust port 102.

The fluid control apparatus 90 shown in FIG. 21 includes a first member 92, a second member 93, a third member 94, a fourth member 95, a fifth member 96 having a vibration portion 961 and a fixed portion 962, a sixth member 97, a drive mechanism 4, the two intake ports 101, the one exhaust port 102, and valve modules 13 provided in the intake ports 101 and the exhaust port 102, respectively. The first to sixth members are plate-like members.

In the fluid control apparatus 90 shown in FIG. 21, the third member 94, the fourth member 95, and the fifth member 96 form a space 19. Moreover, the two intake ports 101 are provided in the fixed portion 962 of the fifth member 96 and the one exhaust port 102 is provided at an edge portion of the third member 94. The drive mechanism 4 is positioned below the fifth member 96, held in contact with the vibration portion 961.

Figure 22:
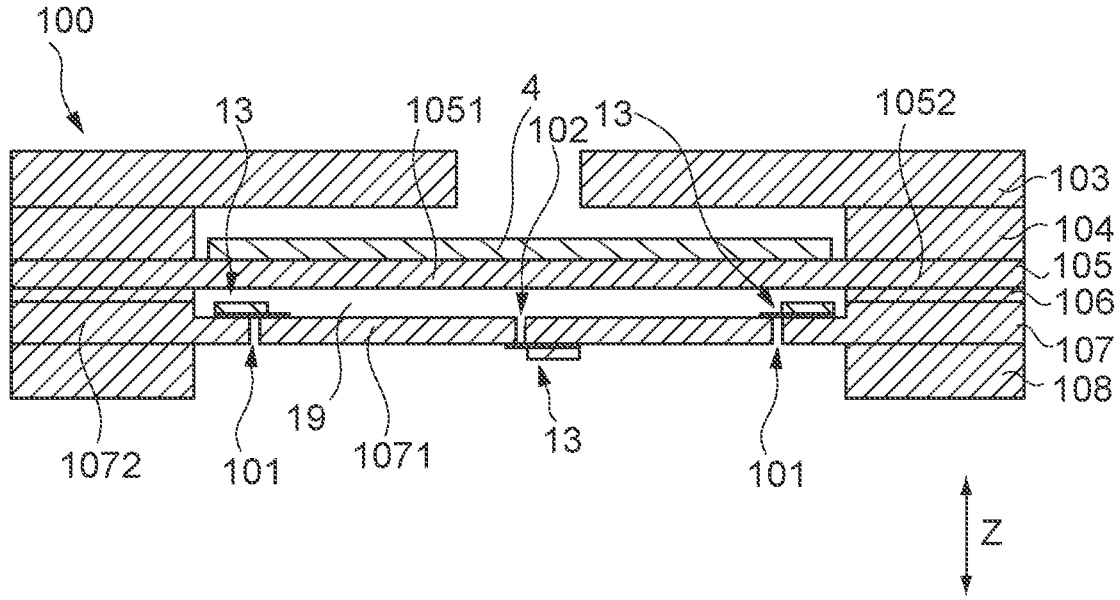
FIG. 22 A partial schematic cross-sectional view of a fluid control apparatus in still another example.

A fluid control apparatus 100 shown in FIG. 22 includes one drive mechanism 4, two intake ports 101, and one exhaust port 102.

The fluid control apparatus 100 shown in FIG. 22 includes a first member 103, a second member 104, a third member 105 having a vibration portion 1051 and a fixed portion 1052, a fourth member 106, a fifth member 107 having a vibration portion 1071 and a fixed portion 1072, a sixth member 108, a drive mechanism 4, the two intake ports 101, the one exhaust port 102, and valve modules 13 provided in the intake ports 101 and the exhaust port 102, respectively. The first to sixth members are plate-like members.

In the fluid control apparatus 90 shown in FIG. 22, the third member 105, the fourth member 106, and the fifth member 107 form a space 19. The drive mechanism 4 is positioned above the third member 105, held in contact with the vibration portion 1051. The two intake ports 101 and the one exhaust port 102 are provided in the vibration portion 1071 of the fifth member 107.

In this manner, the intake ports 101 and the exhaust port 102 may be provided in the vibration portion 1071 opposite to the drive mechanism 4. In the fluid control apparatus, a pressure V generated due to displacement of the vibration portion (elastic body, diaphragm) is produced due to a ratio of a volume VO of the space (pump chamber) to the amount of change in volume $\Delta V$ generated by the displacement of the vibration portion, and it is favorable to set VO to be as small as possible by reducing the extra flow channel volume. Therefore, by employing a configuration in which the valve module is mounted on the surface of the vibration portion, the extra flow channel volume can be reduced and VO can be further reduced.

Also in the fluid control apparatuses having various configurations as described above, the valve module according to the present technology can be favorably used. That is, since the valve module according to the present technology is configured separately from the fluid control apparatus main body and the characteristics of each valve module 13 can be controlled by changing at least one of the kind of the material or thickness of the movable member 16, the size and shape of the movable member 16 or the support member 15, or the L-length, the valve module according to the present technology can be used for various fluid control apparatuses.

The bending spring constant of the movable valve can be adjusted for each valve module by changing at least one of the material, the thickness, the shape, the size, the shape of the support member (support shape), the L-length, or the like of the movable member of the valve module and fabricating the valve module.

For example, in a case where the size of the fluid control apparatus is limited, a configuration in which the number of intake ports and the number of exhaust ports are set to be different is sometimes employed as in FIGS. 18, 19 and 21. In such a case, when the valve modules having the same characteristics are used for the intake ports and the exhaust ports, the pressure, the state of the airflow added to the movable valve of each valve module is different. However, as described above, in the valve module according to the present technology, the characteristics can be changed for each valve module by changing at least one of the material, the thickness, the shape, the size, the shape of the support member (support shape), the L-length, or the like of the movable member and fabricating the valve module. Thus, also in the fluid control apparatuses in which the number of intake ports and the number of exhaust ports are different, the valve module suitable for each of the intake ports and the exhaust ports can be provided, and the fluid control apparatuses having an excellent fluid transporting characteristic can be provided.

The valve module according to the present technology is particularly suitable to the compact fluid control apparatus. That is, although the arrangement positions of the valve modules in the compact fluid control apparatus are liable to be limited, regarding the valve modules according to the present technology, a valve module suitable for each of the corresponding openings can be easily fabricated.

Moreover, even in a case where the number of intake ports and the number of exhaust ports are different, there can be a flow difference of the airflow between the sucking side and the discharging side, for example, depending on the arrangement relationship or the like of the intake port and the exhaust port. As an example, in a case where the movable valve is lifted greatly due to the airflow on the discharging side and returns late, there is a loss in the fluid transportation. In such a case, the fluid transportation efficiency can be improved by setting at least one of the material, the thickness, the shape, the size, the shape of the support member (support shape), the L-length, or the like of the movable member to be different and fabricating the valve module so that the bending spring constant of the movable valve of the valve module on the discharging side is larger than the movable valve of the valve module on the sucking side.

[Supplementary Description of this Embodiment]

Hereinafter, a supplementary description of this embodiment will be given.

(Respective Dimension Examples of Valve Module, Etc.)

Hereinafter, dimension examples of the valve module, etc. will be described, though not limited thereto.

Figure 23:
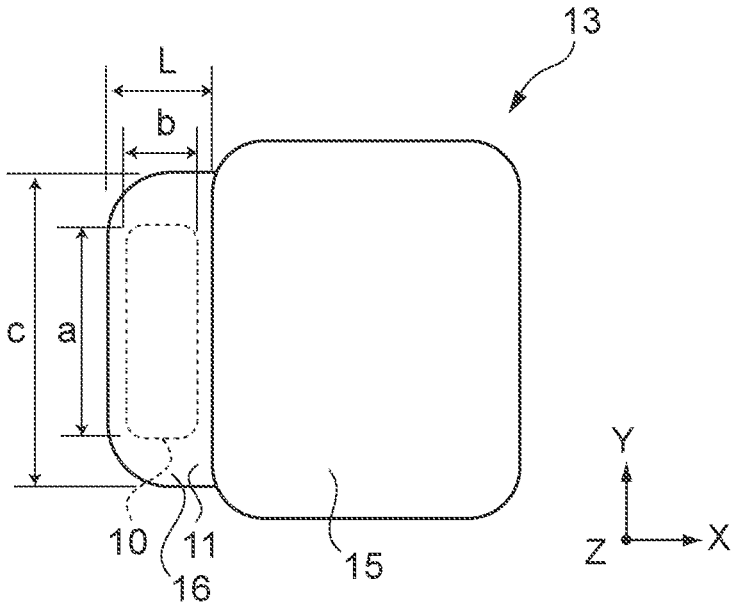
FIG. 23 A plan view of the valve module.

As shown in FIG. 23, regarding the opening dimension of the opening 10 covered with the movable valve 11 of the valve module 13, in order to follow ultrasonic frequency vibration, it is desirable that for example, a length a in the Y-axis direction be 1 mm to 2 mm and a length b in the X-axis direction be 0.1 mm to 0.5 mm.

The size to cover at least the opening 10 is required for the movable valve 11 of the valve module 13. A length c of the movable valve 11 in the Y-axis direction is, for example, 1.2 mm to 2.2 mm in order to follow ultrasonic frequency vibration, and the length L (L-length) in the X-axis direction is 0.2 mm to 0.6 mm.

The L-length can be set as appropriate depending on the specific gravity and the Young's modulus of the material used for the movable member 16, the thickness of the movable member 16, a target primary resonance frequency of the vibration portion, and the like.

(Regarding Thickness of Movable Member and L-Length)

The L-length can be changed as appropriate in accordance with the thickness of the movable member 16, a target primary resonance frequency of the vibration portion, and the like.

Hereinafter, the plurality of valve modules was fabricated by changing the material of the movable member 16, the thickness of the movable member 16, and the L-length of the movable valve 11.

As the material of the movable member 16 of the valve module 13, polyimide films having a thickness of 7.5 μm and a thickness of 12.5 μm, which have a specific gravity of 1.45 and a Young's modulus of 5.8 GPa, and polyamide films having a thickness of 4.5 μm and a thickness of 12.5 μm, which have specific gravity of 1.4 and a Young's modulus of 10 GPa, were used.

As the material of the support member 15, a stainless-steel film having a Young's modulus of 190 GPa and a thickness of 50 μm was used.

In FIG. 23, regarding the opening dimension of the opening 10 at the time of assessment of the fabricated valve module 13, the length in the X-axis direction was set to 1.5 mm and the length in the Y-axis direction was set to 0.3 mm.

In FIG. 23, the length c in the Y-axis direction of the movable valve 11 of the valve module 13 was set to 1.7 mm.

The L-length was set to 0.3 mm, 0.35 mm, 0.4 mm, 0.45 mm, or 0.5 mm.

As to two kinds of polyimide and polyamide as the material of the movable member, each valve module 13 fabricated by changing the thickness and the L-length was installed in the fluid control apparatus 1 and a primary resonance frequency and a displacement amount of the movable valve 11 at the pressure of 1 kPa were calculated. Calculation results of the primary resonance frequency were shown in Table 1. Calculation results of the displacement amount were shown in Table 2.

TABLE 1

| L-length (mm) | Polyimide 7.5 um | Polyimide 12.5 um | Polyamide 4.5 um | Polyamide 12.5 um |
|---|---|---|---|---|
| 0.3 | 26,920 | 44,867 | 24,350 | 67,640 |
| 0.35 | 19,778 | 32,964 | 17,890 | 49,695 |
| 0.4 | 15,143 | 25,238 | 13,697 | 38,047 |
| 0.45 | 11,965 | 19,941 | 10,882 | 30,062 |
| 0.5 | 9,691 | 16,152 | 8,766 | 24,350 |

TABLE 2

| L-length (mm) | Polyimide 7.5 um | Polyimide 12.5 um | Polyamide 4.5 um | Polyamide 12.5 um |
|---|---|---|---|---|
| 0.3 | 0.0066 | 0.0014 | 0.0177 | 0.0008 |
| 0.35 | 0.0105 | 0.0023 | 0.0282 | 0.0013 |
| 0.4 | 0.0157 | 0.0034 | 0.0421 | 0.0020 |
| 0.45 | 0.0223 | 0.0048 | 0.0600 | 0.0028 |
| 0.5 | 0.0307 | 0.0066 | 0.0823 | 0.0038 |

As shown in Table 1, as the L-length of the movable valve 11 becomes shorter, the primary resonance frequency becomes higher, and as the thickness of the movable valve 11 becomes larger, the primary resonance frequency becomes higher. As the primary resonance frequency becomes higher, the flow rate per unit time can be higher.

As shown in Table 2, the displacement amount of the movable valve 11 with respect to the pressure of 1 kPa becomes smaller as the L-length of the movable valve 11 becomes shorter. Moreover, the displacement amount of the movable valve 11 with respect to the pressure of 1 kPa becomes smaller as the thickness of the movable valve 11 becomes larger. As the displacement amount becomes smaller, the flow rate becomes smaller.

For example, as shown in Table 2, the displacement amount of the polyimide film having an L-length of 0.3 mm and a thickness of 7.5 μm is 0.0066, and an L-length of about 0.4 mm is required for obtaining a displacement amount approximately equal to this displacement amount by using a polyimide film having a thickness of 12.5 μm.

As shown in Table 1, the resonant frequency of the polyimide film having an L-length of 0.3 mm and a thickness of 7.5 μm is 26920 Hz. In contrast, the resonant frequency of the polyimide film having an L-length of 0.5 mm and a thickness of 12.5 μm is 16152 Hz.

As described above, even in a case where the movable valves 11 are made from the same material and exhibit the approximately equal displacement amount, the primary resonance frequency characteristics are different depending on the thickness and L-length. Thus, the material used for the movable member and the thickness and L-length can be set as appropriate so that a target primary resonance frequency characteristic is met and the flow rate increases.

For example, in the examples shown in Tables 1 and 2, in a case where it is an aim to fabricate the valve module having a primary resonance frequency characteristic of about 20 kHz or more, the valve module can be fabricated by selecting a polyimide film having a large displacement amount and a thickness of 7.5 μm, which meets this aim, as the material of the movable member 16 and setting the L-length to 0.3 mm to 0.35 mm.

Accordingly, the valve module excellent in the fluid transportation can be obtained. Since frequencies equal to or higher than 19 to 20 kHz are frequencies inaudible to humanity, vibration sound of the vibration portion (diaphragm) is hardly perceived as noise. It should be noted that here, the description has been given using the resonant frequency of about 20 kHz or more as an example, though not limited thereto. The resonant frequency may be several hundreds of Hz, several kHz, or the like, and the present technology can be applied.

By changing the Young's modulus and the specific gravity of the movable member 16, the thickness of the movable member 16, the L-length, and the kind of the material as described above, the characteristics can be adjusted for each valve module 13.

Accordingly, the design change such as tuning of the pump characteristics of the fluid control apparatus using this valve module can be easily performed by changing the material of the movable member in the valve module, for example.

(Response Characteristics of Valve Module)

Figure 24:
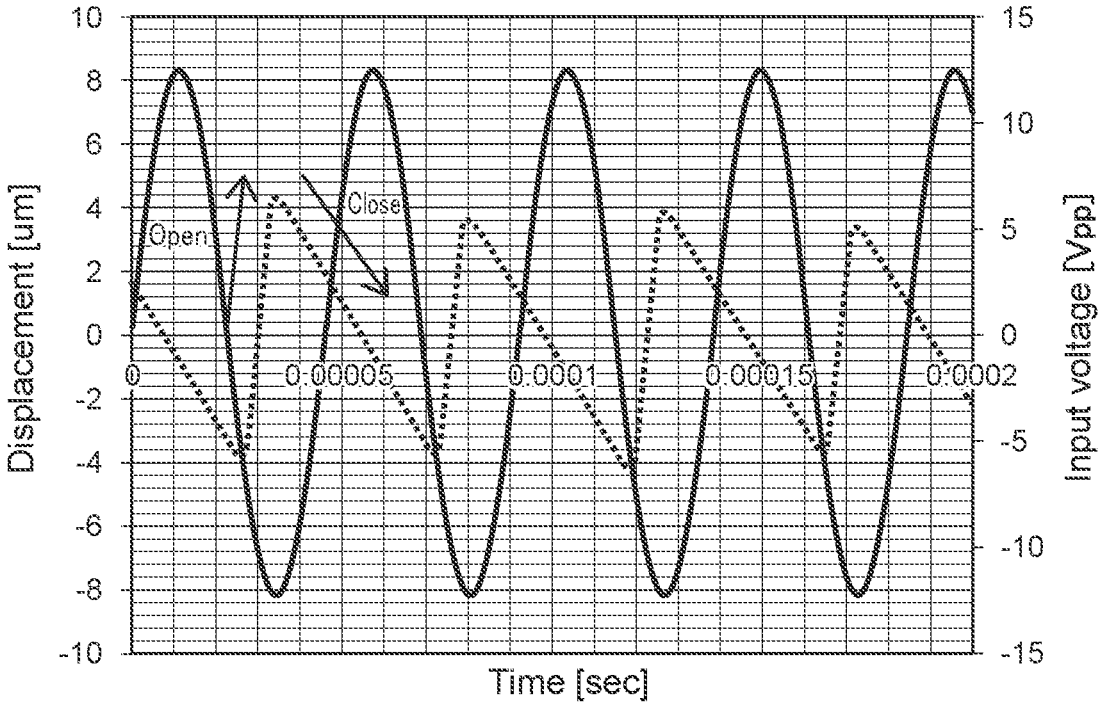
FIG. 24 A diagram showing response characteristics of the movable valve of the valve module in the fluid control apparatus according to this embodiment.

FIG. 24 is a diagram showing the response characteristics of the valve module 13 when the diaphragm (vibrator) is vibrating at 21.7 kHz in the fluid control apparatus 1 installing the valve module 13 according to this embodiment. In FIG. 24, the solid line indicates an input voltage waveform to the drive mechanism (piezoelectric element) 4. The dotted line indicates the displacement amount of the movable valve 11. In the drawing, when the displacement amount increases, it is the state in which the movable valve 11 is opened, and when the displacement amount decreases, it is the state in which the movable valve 11 is closed.

A polyimide film having a thickness of 5 μm, a specific gravity of 2 or less, and a Young's modulus of 5 GPa or less was used for the movable valve 11 of the valve module 13. A stainless-steel film having a Young's modulus of 6 GPa or more was used for the material of the support member 15. The L-length was set to 0.4 mm to 0.5 mm.

As shown in FIG. 24, in the fluid control apparatus 1 installing the valve module 13 according to this embodiment, it has been found that the movable valve 11 performs displacement response, following a voltage input to the piezoelectric element (drive mechanism). It has been confirmed, by using, in this manner, a movable member having a specific gravity of 2 or less and a Young's modulus of 5 GPa or less, using a support member, and using a valve module having an L-length of 0.4 mm to 0.5 mm, the movable valve of the valve module responds and the check valve function can be sufficiently exerted, following pressure variations of the space (pump chamber) that are generated due to high-frequency vibration at 21.7 kHz of the vibration portion, which is generated by a voltage input to the piezoelectric element (drive mechanism).

[Regarding Electronic Apparatus]

Although applications of the fluid control apparatuses 1, 31, 53, 60, 61, 80, 81, 90, and 100 are not particularly limited, and they can be installed in the electronic apparatus, for example. The fluid control apparatuses 1, 31, 53, 60, 61, 80, 81, 90, and 100 are capable of discharging the air inside the electronic apparatus to the outside or sucking the air from the outside of the electronic apparatus.

Each of the above-mentioned fluid control apparatuses can be utilized as a cooling device that suppresses heat generation by spraying a fluid to a heat generator inside the electronic apparatus. For example, the fluid control apparatus can be installed in a portable apparatus such as the portable phone so as to be capable of cooling.

Moreover, the fluid control apparatus can be installed in an electronic apparatus such as a tactile presentation apparatus so as to be capable of presenting a pseudo sense of pressure or sense of touch.

Moreover, the fluid control apparatus can be installed in an electronic apparatus such as a sphygmomanometer.

Moreover, each of the above-mentioned fluid control apparatuses can be applied to artificial muscles that are a flexible actuator made of rubber or the like that is stretchable due to the air pressure.

Since the fluid control apparatuses 1, 31, 53, 60, 61, 80, 81, 90, and 100 can be downsized, they can be easily built in an electronic apparatus.

Embodiments of the present technology are not limited to the above-mentioned embodiments and various modifications can be made without departing from the gist of the present technology.

For example, in the above, the opening shape of the opening 10 has been the substantially rectangular shape having the longitudinal direction, though not limited thereto. The opening shape of the opening 10 can be various shapes.

Moreover, for example, in each of the above-mentioned fluid control apparatuses, the example in which the valve modules 13 are provided in the intake port 101 and the exhaust port 102 has been shown, though a mode on which the valve module 13 is provided in only either one of them may be employed. In this case, the hole of the other intake port 101 or exhaust port 102 is not closed. Also on such a mode, in the compact fluid control apparatus, since the volume of the space 19 is quickly increased/decreased, a fluid control apparatus having desired pump characteristics can be obtained by providing the valve module 13 in either one of the intake port 101 and the exhaust port 102. Since the number of valve modules 13 can be reduced on such a mode, the cost can be reduced.

Moreover, for example, in each of the above-mentioned fluid control apparatuses, the example using the displacement of the length in the X-axis direction as the mechanism for changing the volume of the space 19 has been shown, though not limited thereto.

Moreover, in each of the above-mentioned fluid control apparatuses, the example using the piezoelectric element has been shown as the drive mechanism, though not limited thereto. It is sufficient that the drive mechanism can bend the vibration portion as the drive mechanism.

It should be noted that the present technology may also take the following configurations.

(1) A valve module, including:

a movable member constituted by a film elastically deformable by a fluid and having a first surface positioned on a side of a member having an opening through which the fluid passes and a second surface on a side opposite to the first surface; and a support member has higher rigidity than rigidity of the movable member, covers a part of a region of the second surface, in which the opening is not located as viewed in a direction perpendicular to the second surface, and is fixed to the member.

(2) The valve module according to (1), in which the movable member is constituted by an organic film having a Young's modulus of 5 GPa or less and a thickness of 20 μm or less or a metal film having a Young's modulus of 5 GPa or less and a thickness of 10 μm or less.

(3) The valve module according to (1) or (2), in which the movable member has specific gravity of 2 or less.

(4) The valve module according to (3), in which the movable member is an organic film made from polyimide or polyethylene terephthalate.

(5) The valve module according to (4), in which the movable member is a metal film made from an alloy of nickel and iron or a stainless steel.

(6) The valve module according to any one of (1) to (5), in which the support member has a Young's modulus of 6 GPa or more.

(7) The valve module according to (6), in which the support member is a metal film made from an alloy of nickel and iron or a stainless steel.

(8) The valve module according to any one of (1) to (7), further including an overlapping region in which the movable member and the support member overlap each other and a non-overlapping region in which only the support member is located, and an end portion of the support member that defines a boundary between the overlapping region and the non-overlapping region has a straight line shape or a shape including a curve line-shaped portion.

(9) The valve module according to any one of (1) to (8), further including an overlapping region in which the movable member and the support member overlap each other and a non-overlapping region in which only the support member is located are provided, and the non-overlapping region includes a first non-overlapping region and a second non-overlapping region are each independently elastically deformable.

(10) The valve module according to (9), in which the first non-overlapping region and the second non-overlapping region have different areas.

(11) A fluid control apparatus, including:

a space in which a fluid is capable of flowing;

two plate-like members, which are opposite to each other with the space between the two plate-like members and at least one of which includes an elastic body having flexibility;

a drive mechanism that bends the elastic body and varies volume of the space;

an opening, which is provided in a member and through which the fluid that flows inside and outside the space passes; and a valve module including a movable member that is disposed in the opening, is constituted by a film elastically deformable by a fluid, and has a first surface positioned on a side of a member having the opening and a second surface on a side opposite to the first surface and a support member that has higher rigidity than rigidity of the movable member, covers a part of a region of the second surface, in which the opening is not located as viewed in a direction perpendicular to the second surface, and is fixed to the member.

(12) The fluid control apparatus according to (11), further including a recess portion on which the valve module is mounted, in which the valve module is positioned in such a manner that an end portion of the valve module is brought into contact with an inner surface of the recess portion.

(13) The fluid control apparatus according to (11) or (12), in which the opening includes an intake port that sucks the fluid into the space and an exhaust port that discharges from the space into the fluid, and the intake port and the exhaust port are different in number.

(14) The fluid control apparatus according to any one of (11) to (13), in which the opening includes an intake port that sucks the fluid into the space and an exhaust port that discharges from the space into the fluid, the valve module is disposed in each of the intake port and the exhaust port, and the movable member of the valve module provided in the intake port and the movable member of the valve module provided in the exhaust port are different in thickness.

(15) The fluid control apparatus according to any one of (11) to (14), in which the opening includes an intake port that sucks the fluid into the space and an exhaust port that discharges from the space into the fluid, the valve module is disposed in each of the intake port and the exhaust port, and the movable member of the valve module provided in the intake port and the movable member of the valve module provided in the exhaust port are different in shape.

(16) The fluid control apparatus according to any one of (11) to (15), in which the opening includes an intake port that sucks the fluid into the space and an exhaust port that discharges from the space into the fluid, the valve module is disposed in each of the intake port and the exhaust port, and the support member of the valve module provided in the intake port and the support member of the valve module provided in the exhaust port are different in shape.

(17) The fluid control apparatus according to any one of (11) to (16), in which the opening includes an intake port that sucks the fluid into the space and an exhaust port that discharges from the space into the fluid, the valve module is disposed in each of the intake port and the exhaust port, and the movable member of the valve module provided in the intake port and the movable member of the valve module provided in the exhaust port are different in material.

(18) The fluid control apparatus according to any one of (11) to (17), in which the opening includes an intake port that sucks the fluid into the space and an exhaust port that discharges from the space into the fluid, and at least one of the intake port or the exhaust port is provided in the elastic body and the valve module is mounted on the elastic body.

(19) An electronic apparatus, including
a fluid control apparatus including
a space in which a fluid is capable of flowing,
two plate-like members, which are opposite to each other with the space between the two plate-like members and at least one of which includes an elastic body having flexibility,
a drive mechanism that bends the elastic body and varies volume of the space,
an opening provided in a member through which the fluid that flows inside and outside the space passes, and
a valve module including
a movable member that is disposed in the opening, is constituted by a film elastically deformable by a fluid, and has a first surface positioned on a side of a member having the opening and a second surface on a side opposite to the first surface, and
a support member that has higher rigidity than rigidity of the movable member, covers a part of a region of the second surface, in which the opening is not located as viewed in a direction perpendicular to the second surface, and is fixed to the member.

REFERENCE SIGNS LIST

1, 31, 53, 60, 61, 80, 81, 90, 100 fluid control apparatus
5 third member (plate-like member)
7 fifth member (plate-like member)
10 opening
11 exhaust port
12 intake port
13 valve module
15 support member
16 movable member
16*a* first surface
16*b* second surface
17, 18 recess portion
19 space
21 overlapping region
22 non-overlapping region
221 first non-overlapping region
222 second non-overlapping region
41, 42 drive mechanism (piezoelectric element)
51, 71 vibration portion (elastic body)

The invention claimed is:

1. A valve module, comprising:
a movable member that includes a film elastically deformable by a fluid, wherein
the movable member has a first surface on a side of a member plate that has an opening through which the fluid passes,
the movable member has a second surface on a side opposite to the first surface,
the opening has a length of 1 mm to 2 mm in a y-axis direction,
the opening has a length of 0.1 mm to 0.5 mm in an x-axis direction, and
the x-axis direction is perpendicular to the y-axis direction and is in a common plane with the y-axis direction;
a support member that has higher rigidity than a rigidity of the movable member, wherein
the support member covers a part of a region of the second surface in which the opening is not located as viewed in a direction perpendicular to the second surface, and
the support member is fixed to the member plate;
an overlapping region in which the movable member overlaps with the support member; and
a non-overlapping region includes a first non-overlapping region and a second non-overlapping region, wherein
the movable member is in the first non-overlapping region and the second non-overlapping region, and
the overlapping region is between the first non-overlapping region and the second non-overlapping region.

2. The valve module according to claim 1, wherein the film of the movable member is one of an organic film having a Young's modulus of 5 GPa or less and a thickness of 20 μm or less or a first metal film having a Young's modulus of 5 GPa or less and a thickness of 10 μm or less.

3. The valve module according to claim 2, wherein the movable member has a specific gravity of 2 or less.

4. The valve module according to claim 3, wherein the organic film is made from one of polyimide or polyethylene terephthalate.

5. The valve module according to claim 2, wherein the first metal film is made from one of an alloy of nickel and iron or a stainless steel.

6. The valve module according to claim 2, wherein the support member has a Young's modulus of 6 GPa or more.

7. The valve module according to claim 6, wherein the support member is a second metal film made from one of an alloy of nickel and iron or a stainless steel.

8. The valve module according to claim 1, wherein
an end portion of the support member is a boundary between the overlapping region and the non-overlapping region, and
the end portion has one of a straight-line shape or a curve-line shape.

9. The valve module according to claim 1, wherein each of the first non-overlapping region and the second non-overlapping region are elastically deformable.

10. The valve module according to claim 9, wherein the first non-overlapping region and the second non-overlapping region have different areas.

11. A fluid control apparatus, comprising:
a space in which a fluid flows;
a first member plate;
a second member plate, wherein
the first member plate is opposite to the second member plate,
the space is between the first member plate and the second member plate, and
at least one of the first member plate or the second member plate includes an elastic body that has flexibility;
a drive mechanism configured to:
bend the elastic body, and
vary a volume of the space;
a first opening in the first member plate;
a second opening in the second member plate, wherein
the first opening has a length of 1 mm to 2 mm in a y-axis direction,
the first opening has a length of 0.1 mm to 0.5 mm in an x-axis direction,
the x-axis direction is perpendicular to the y-axis direction and is in a common plane with the y-axis direction,
the fluid flows through the first opening to inside the space, and
the fluid flows through the second opening to outside the space; and
a first valve module including:

a first movable member adjacent to the first opening, wherein the first movable member is constituted by a film elastically deformable by the fluid, the first movable member has a first surface on a side of the first member plate that has the first opening, and the first movable member has a second surface on a side opposite to the first surface;

a first support member that has higher rigidity than a rigidity of the first movable member, wherein the first support member covers a part of a region of the second surface in which the first opening is not located as viewed in a direction perpendicular to the second surface, and the first support member is fixed to the first member plate;

an overlapping region in which the first movable member overlaps with the first support member; and a non-overlapping region includes a first non-overlapping region and a second non-overlapping region, wherein the first movable member is in the first non-overlapping region and the second non-overlapping region, and the overlapping region is between the first non-overlapping region and the second non-overlapping region.

12. The fluid control apparatus according to claim 11, further comprising a recess portion on which the first valve module is mounted, wherein an end portion of the first valve module is in contact with an inner surface of the recess portion.

13. The fluid control apparatus according to claim 11, wherein the first opening corresponds to an intake port that sucks the fluid into the space, and the second opening corresponds to an exhaust port that discharges the fluid from the space.

14. The fluid control apparatus according to claim 11, wherein the first opening corresponds to an intake port that sucks the fluid into the space, the second opening corresponds to an exhaust port that discharges the fluid from the space, the first valve module is adjacent to the intake port, a second valve module is adjacent to the exhaust port, and a thickness of the first movable member of the first valve module is different from a thickness of a second movable member of the second valve module.

15. The fluid control apparatus according to claim 11, wherein the first opening corresponds to an intake port that sucks the fluid into the space, the second opening corresponds to an exhaust port that discharges the fluid from the space, the first valve module is adjacent to the intake port, a second valve module is adjacent to the exhaust port, and a shape of the first movable member of the first valve module is different from a shape of a second movable member of the second valve module.

16. The fluid control apparatus according to claim 11, wherein the first opening corresponds to an intake port that sucks the fluid into the space, the second opening corresponds to an exhaust port that discharges the fluid from the space, the first valve module is adjacent to the intake port, a second valve module is adjacent to the exhaust port, and a shape of the first support member of the first valve module is different from a shape of a second support member of the second valve module.

17. The fluid control apparatus according to claim 11, wherein the first opening corresponds to an intake port that sucks the fluid into the space, the second opening corresponds to an exhaust port that discharges the fluid from the space, the first valve module is adjacent to the intake port, a second valve module is adjacent to the exhaust port, and a material of the first movable member of the first valve module is different from a material of a second movable member of the second valve module.

18. The fluid control apparatus according to claim 11, wherein the first opening corresponds to an intake port that sucks the fluid into the space, the second opening corresponds to an exhaust port that discharges the fluid from the space, one of the intake port or the exhaust port is in the elastic body, and the first valve module is mounted on the elastic body.

19. An electronic apparatus, comprising:

a fluid control apparatus that includes:

a space in which a fluid flows;

a first member plate;

a second member plate, wherein the first member plate is opposite to the second member plate, the space is between the first member plate and the second member plate, and at least one of the first member plate or the second member plate includes an elastic body that has flexibility;

a drive mechanism configured to:

bend the elastic body, and vary a volume of the space;

an opening in the first member plate, wherein the opening has a length of 1 mm to 2 mm in a y-axis direction, the opening has a length of 0.1 mm to 0.5 mm in an x-axis direction, the x-axis direction is perpendicular to the y-axis direction and is in a common plane with the y-axis direction, the fluid flows, through the opening, to one of inside the space or outside the space; and a first valve module including:

a first movable member adjacent to the opening, wherein the first movable member is constituted by a film elastically deformable by the fluid, the first movable member has a first surface on a side of the first member plate that has the opening, and the first movable member has a second surface on a side opposite to the first surface;

a first support member that has higher rigidity than a rigidity of the first movable member, wherein the first support member covers a part of a region of the second surface in which the opening is not located as viewed in a direction perpendicular to the second surface, and the first support member is fixed to the first member plate;

an overlapping region in which the first movable member overlaps with the first support member; and a non-overlapping region includes a first non-overlapping region and a second non-overlapping region, wherein the first movable member is in the first non-overlapping region and the second non-overlapping region, and the overlapping region is between the first non-overlapping region and the second non-overlapping region.

* * * * *